US005476081A

United States Patent [19]

Okawa et al.

[11] Patent Number: 5,476,081

[45] Date of Patent: Dec. 19, 1995

[54] APPARATUS FOR CONTROLLING AIR-FUEL RATIO OF AIR-FUEL MIXTURE TO AN ENGINE HAVING AN EVAPORATED FUEL PURGE SYSTEM

[75] Inventors: Koji Okawa, Toyota; Mitsuru Takada, Aichi; Nobuyuki Kobayashi, Toyota; Shuji Yuda; Kenji Harima, both of Susono; Toshinari Nagai, Sunto; Hiroshi Kanai; Akinori Osanai, both of Susono; Kazuhiko Iwano, Aichi, all of Japan

[73] Assignee: Toyota Jidosha Kabushiki Kaisha, Toyota, Japan

[21] Appl. No.: 259,230

[22] Filed: Jun. 13, 1994

[30] Foreign Application Priority Data

| | | | |
|---|---|---|---|
| Jun. 14, 1993 | [JP] | Japan | 5-142215 |
| Oct. 22, 1993 | [JP] | Japan | 5-265240 |
| Apr. 14, 1994 | [JP] | Japan | 6-75530 |

[51] Int. Cl.[6] ..... F02M 51/00; F02M 25/08; F02D 41/04

[52] U.S. Cl. ..... 123/478; 123/480; 123/520

[58] Field of Search ..... 123/478, 520, 123/480, 698, 357, 519

[56] References Cited

U.S. PATENT DOCUMENTS

| | | | |
|---|---|---|---|
| 4,967,715 | 11/1990 | Hosaka | 123/478 |
| 5,085,194 | 2/1992 | Kuroda et al. . | |
| 5,090,388 | 2/1992 | Hamburg et al. . | |
| 5,143,040 | 9/1992 | Okawa et al. . | |
| 5,150,696 | 9/1992 | Kabasin et al. . | |
| 5,215,061 | 6/1993 | Ogawa et al. | 123/478 |
| 5,216,997 | 6/1993 | Osanai et al. . | |
| 5,216,998 | 6/1993 | Hosoda et al. . | |
| 5,224,462 | 7/1993 | Orzel . | |
| 5,245,978 | 9/1993 | Orzel . | |
| 5,257,613 | 11/1993 | Monda et al. . | |
| 5,267,548 | 12/1993 | Rosenzopf et al. . | |
| 5,282,449 | 2/1994 | Takahashi et al. | 123/480 |
| 5,299,546 | 4/1994 | Kato et al. | 123/520 |
| 5,351,193 | 9/1994 | Poirier et al. | 123/520 |
| 5,359,980 | 11/1994 | Tomisawa | 123/478 |

FOREIGN PATENT DOCUMENTS

| | | |
|---|---|---|
| 4-72453 | 3/1992 | Japan . |
| 5-52139 | 3/1993 | Japan . |
| 5-223022 | 8/1993 | Japan . |

*Primary Examiner*—Thomas N. Moulis
*Attorney, Agent, or Firm*—Kenyon & Kenyon

[57] ABSTRACT

An air-fuel ratio control apparatus includes: a determining part for determining a target purge ratio in accordance with operating conditions of an engine; a purge control part for controlling a flow rate of evaporated fuel, supplied from an evaporated fuel purge system into an intake passage of the engine, by actuating a purge control valve based on the target purge ratio, and for storing an evaporated fuel flow rate of the purge control valve; a fuel injection control part for generating a drive signal in accordance with a fuel injection time, and for controlling an air-fuel ratio of an air-fuel mixture to the intake passage by actuating a fuel injection valve in accordance with the drive signal; an estimating part for estimating the ratio of an evaporated fuel flow rate to an intake air flow rate based on sensed operating conditions of the engine and on the stored evaporated fuel flow rate of the purge control part; and a fuel injection time determining part for determining a fuel injection time based on the estimated ratio, and for supplying the fuel injection time to the fuel injection control part.

9 Claims, 21 Drawing Sheets

O

START
DELAY

ON
OFF
t0 t1
t2

CONTROL DELAY
O

ON
OFF
t3 t4
TRANSPORT
TIME t5
SHIFT

O

T0
T1

CONTROL DELAY
O

T2
T3
TRANSPORT
TIME

T4

T0
T1
LEVEL OF TAUmin
ON
OFF
CONTROL DELAY
T2
T3
TRANSPORT TIME
T4

APPARATUS FOR CONTROLLING AIR-FUEL RATIO OF AIR-FUEL MIXTURE TO AN ENGINE HAVING AN EVAPORATED FUEL PURGE SYSTEM

BACKGROUND OF THE INVENTION

1. Field of the Invention

The present invention generally relates to an air-fuel ratio control apparatus, and more particularly to an apparatus for controlling an air-fuel ratio of an air-fuel mixture to an internal combustion engine having an evaporated fuel purge system.

2. Description of the Related Art

Recently, there have been many automotive engines provided with an evaporated fuel purge system. In the evaporated fuel purge system, evaporated fuel from a fuel tank is supplied to a canister via a vapor line between the fuel tank and the canister. The canister contains absorbent such as active carbon, and the evaporated fuel from the fuel tank is absorbed by the absorbent of the canister. The canister is connected to an intake passage of the engine through a purge line. The evaporated fuel purge system supplies or discharges the absorbed fuel of the canister to the intake passage through a purge control valve, arranged in the purge line, under a prescribed operating condition of the engine.

Generally, higher combustion efficiencies of automotive engines with desired exhaust emission can be acquired if an air-fuel ratio of an air-fuel mixture, supplied to the engine, is set to approximately the stoichiometric air-fuel ratio. Thus, for automotive engines vehicles requiring higher combustion efficiencies, it is necessary to perform an air-fuel ratio feedback control procedure in which the air-fuel ratio is determined in accordance with the stoichiometric air-fuel ratio.

U.S. patent application Ser. No. 08/085,571 filed on Jun. 30, 1993, assigned to the assignee of the present invention, discloses a proposed air-fuel ratio control apparatus for an internal combustion engine having an evaporated fuel purge system.

In the proposed air-fuel ratio control apparatus, the air-fuel ratio controlling is performed based on the principles that the purge ratio, indicating the ratio of a purge fuel flow rate to an intake air flow rate, is constant, and that the air-fuel mixture is not affected by the purge fuel flow. Based on the principles, the purge control valve is actuated with a drive signal in accordance with the constant purge ratio. Based on the principles, a correction factor is determined in accordance with the purge ratio, and a corrected fuel injection time is determined by multiplying a basic fuel injection time by the correction factor. A fuel injection valve, supplying fuel to the engine, is actuated in accordance with the corrected fuel injection time.

However, the purge control valve has a control delay in response to a drive signal. When the engine is operating in a transient condition in which the intake air flow rate abruptly changes, the purge ratio cannot be maintained at a constant level on the proposed air-fuel ratio control apparatus. The air-fuel ratio of the air-fuel mixture, supplied to the engine at this time, is considerably affected by the purge fuel flow due to the control delay of the purge control valve. The air-fuel ratio considerably deviates from the stoichiometric air-fuel ratio, causing the exhaust emission to deteriorate.

SUMMARY OF THE INVENTION

Accordingly, it is a general object of the present invention to provide an improved apparatus in which the above described problem is eliminated.

Another, more specific object of the present invention is to provide an air-fuel ratio control apparatus for an engine having an evaporated fuel purge system wherein an air-fuel ratio of an air-fuel mixture supplied to the engine can be controlled at appropriate values even when the engine is operating in a transient condition in which the intake air flow rate abruptly changes.

The above mentioned objects of the present invention are achieved by an air-fuel ratio control apparatus which includes: a target purge ratio determining part for determining a target purge ratio in accordance with operating conditions of an internal combustion engine; a purge control part for controlling a flow rate of evaporated fuel, supplied from an evaporated fuel purge system into an intake passage of the engine, by actuating a purge control valve based on the target purge ratio, and for storing an evaporated fuel flow rate of the purge control valve; a fuel injection control part for generating a drive signal in accordance with a fuel injection time, and for controlling an air-fuel ratio of an air-fuel mixture supplied to the engine by actuating a fuel injection valve in accordance with the drive signal; an estimating part for estimating the ratio of an evaporated fuel flow rate to an intake air flow rate based on sensed operating conditions of the engine and on the stored evaporated fuel flow rate of the purge control part; and a fuel injection time determining part for determining a fuel injection time based on the estimated ratio from the estimating part, and for supplying the fuel injection time to the fuel injection control part.

According to the present invention, the actual purge ratio, which is the ratio of the evaporated fuel flow rate to the intake air flow rate, is estimated, and a fuel injection time correcting procedure is carried out based on the estimated actual purge ratio, so as to set the air-fuel ratio of the engine to appropriate values. It is possible to maintain the actual air-fuel ratio of the engine at appropriate values, even when the intake air flow rate fluctuates considerably.

BRIEF DESCRIPTION OF THE DRAWINGS

The other objects, features and advantages of the present invention will be more apparent from the following detailed description when read in conjunction with the accompanying drawings in which.

DESCRIPTION OF THE PREFERRED EMBODIMENTS

Figure 1:
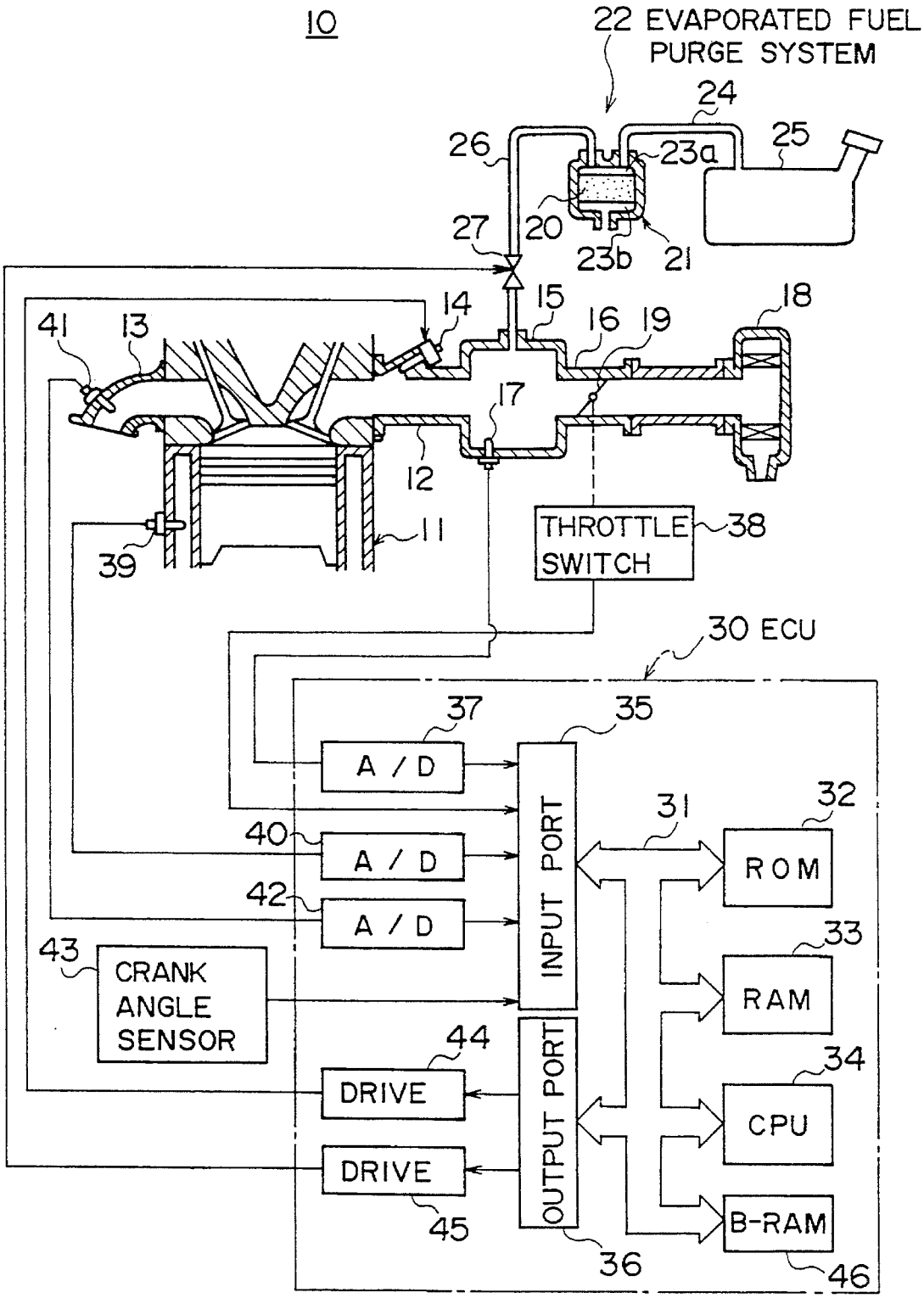
FIG. 1 is a sectional view showing an internal combustion engine to which the present invention is applied.

A description will now be given of an internal combustion engine to which the present invention is applied. FIG. 1 shows an internal combustion engine which is provided with an evaporated fuel purge system.

In FIG. 1, the internal combustion engine 10 comprises an engine block 11, an intake manifold 12, and an exhaust manifold 1. Reference numeral 14 indicates a fuel injection valve for one of a plurality of cylinders of the engine 10. Such fuel injection valves are respectively arranged in the intake manifold 12 for the engine cylinders, and they are connected to a surge tank 15. The surge tank 15 is connected at one end to the intake manifold 12 and connected at the other end to an intake passage 16.

In the internal combustion engine 10 in FIG. 1, an intake air pressure sensor 17 is arranged within the surge tank 15 to measure an intake air pressure in the intake passage 16. An air cleaner 18 is arranged at the leading end of the intake passage 16, and it is connected to the surge tank 15 via the intake passage 16. A throttle valve 19 is arranged at an intermediate portion in the intake passage 16 for controlling a flow of intake air supplied to the engine block 11.

In addition, in the internal combustion engine 10 in FIG. 1, an air flow meter (not shown) is arranged in the intake passage 16 in the vicinity of the air cleaner 18, and an intake air flow rate can be measured by using the air flow meter. A throttle position sensor (not shown) is arranged in the vicinity of the throttle valve 19, and a throttle valve position of the throttle valve 19 can be measured by using the throttle position sensor.

As described above, the engine 10 is provided with an evaporated fuel purge system 22. The evaporated fuel purge system 22 includes a canister 21, and the canister 21 contains active carbon 20 as the absorbent for absorbing evaporated fuel. The canister 21 includes an evaporated fuel chamber 23*a* above the active carbon 20 and an air chamber 23*b* between the active carbon 20 and the atmosphere. The air chamber 23*b* of the canister 21 is open at an air inlet opening to the atmosphere. The evaporated fuel chamber 23*a* of the canister 21 is connected to a fuel tank 25 via a vapor line 24, and the evaporated fuel chamber 23*a* is connected to the surge tank 15 via a purge line 26.

A purge control valve 27 is, for example, a vacuum switching valve (VSV). The purge control valve 27 is arranged at an intermediate portion in the purge line 26 between the canister 21 and the surge tank 15, and it is actuated in accordance with a drive signal supplied from an electronic control unit (ECU) 30 which will be described below.

In the evaporated fuel purge system 22, evaporated fuel from the fuel tank 25 is supplied to the canister 21 via the vapor line 24. The evaporated fuel from the fuel tank 25 is absorbed by the active carbon 20 of the canister 21. As the canister 21 is connected to the surge tank 15 of the intake passage 16 through the purge line 27, the absorbed fuel of the canister 21 is discharged to the intake passage 16 when the purge control valve 27 is switched ON.

When the purge control valve 27 is switched ON, the evaporated fuel chamber 23*a* of the canister 21 is open to the intake passage 16 through the purge line 26. At this time, external air from the air inlet opening of the canister 21 is introduced into the active carbon 20 of the canister 21 due to a negative pressure in the intake passage 16. The external air passes through the active carbon 20 of the canister 21, and it is supplied from the canister 21 to the purge line 26. As the evaporated fuel within the canister 21 is desorbed from the active carbon 20, and the evaporated fuel is supplied to the intake passage 16 via the purge line 26.

In the internal combustion engine 10 in FIG. 1, the electronic control unit (ECU) 30 is composed of a digital computer. The ECU 30 comprises a ROM (read only memory) 32, a RAM (random access memory) 33, a CPU (central processing unit) 34, a B-RAM (backup random access memory) 46, an input port 35, and an output port 36. The ROM 32, the RAM 33, the CPU 34, the B-RAM 46, the input port 35 and the output port 36 mentioned above are interconnected by a bi-directional system bus 31 in the ECU 30.

The ECU 30 comprises an input port 35 and A/D (analog-to-digital) converters 37, 40 and 42. The intake air pressure sensor 17, arranged in the surge tank 15, is connected to the A/D converter 37, and a signal output from the intake air pressure sensor 17 is supplied to the input port 35 through the A/D converter 37.

A throttle switch 38 is coupled to the throttle valve 19. An idle signal is supplied from the throttle switch 38 to the ECU 30 through the input port 35 when the throttle valve 19 is detected to be in the closed condition. An on-state signal is supplied from the throttle switch 38 to the ECU 30 when the opening of the throttle valve 19 is detected to be wider than that of the throttle valve 19 in the closed condition.

As the opening of the throttle valve 19 becomes wider, the flow rate of intake air supplied to the engine 10 becomes higher. The pressure of the surge tank 15 in this case becomes higher and it becomes nearer to the atmospheric pressure. On the other hand, as the opening of the throttle valve 19 becomes narrower, the pressure of the surge tank 15 becomes lower. In the latter case, the absolute value of the negative pressure of the surge tank is becoming greater as the opening of the throttle valve 19 becomes narrower. Thus, the intake air pressure, sensed by the intake air pressure sensor 17, corresponds to the flow rate of the intake air supplied to the engine 10.

A water temperature sensor 39 is arranged on the engine block 11, and a water temperature signal, whose amplitude is proportional to the temperature of engine coolant within the engine block 11, is supplied from the water temperature sensor 39 to the input port 35 through the A/D converter 40.

An oxygen sensor (or an air-fuel ratio sensor) 41 is arranged on the exhaust manifold 13 of the engine 10, and an air-fuel ratio signal from the oxygen sensor 41 is supplied to the input port 35 through the A/D converter 42.

In addition, a crank angle sensor 43 is connected to the input port 35 of the ECU 30. A pulse signal is generated by the crank angle sensor 43 for each of 30° crank angle revolutions of the crankshaft of the engine 10. The pulse signals from the crank angle sensor 43 are supplied to the input port 35 of the ECU 30. An engine speed (NE) is calculated by the CPU 34 based on the pulse signals supplied from the crank angle sensor 43.

The ECU 30 comprises an output port 36 and two valve driving circuits 44 and 45 connected to the output port 36. The valve driving circuit 44 is connected to the fuel injection valve 14 of the engine 10. The valve driving circuit 45 is connected to the purge control valve 27. A fuel injection valve drive signal, generated under the control of the CPU 34, is supplied to the fuel injection valve 14 through the valve driving circuit 44, and a purge control valve drive signal, generated under the control of the CPU 34, is supplied to the purge control valve 27 through the valve driving circuit 45.

Next, a description will be given of an air-fuel ratio control apparatus in the first embodiment of the present invention.

Figure 2:
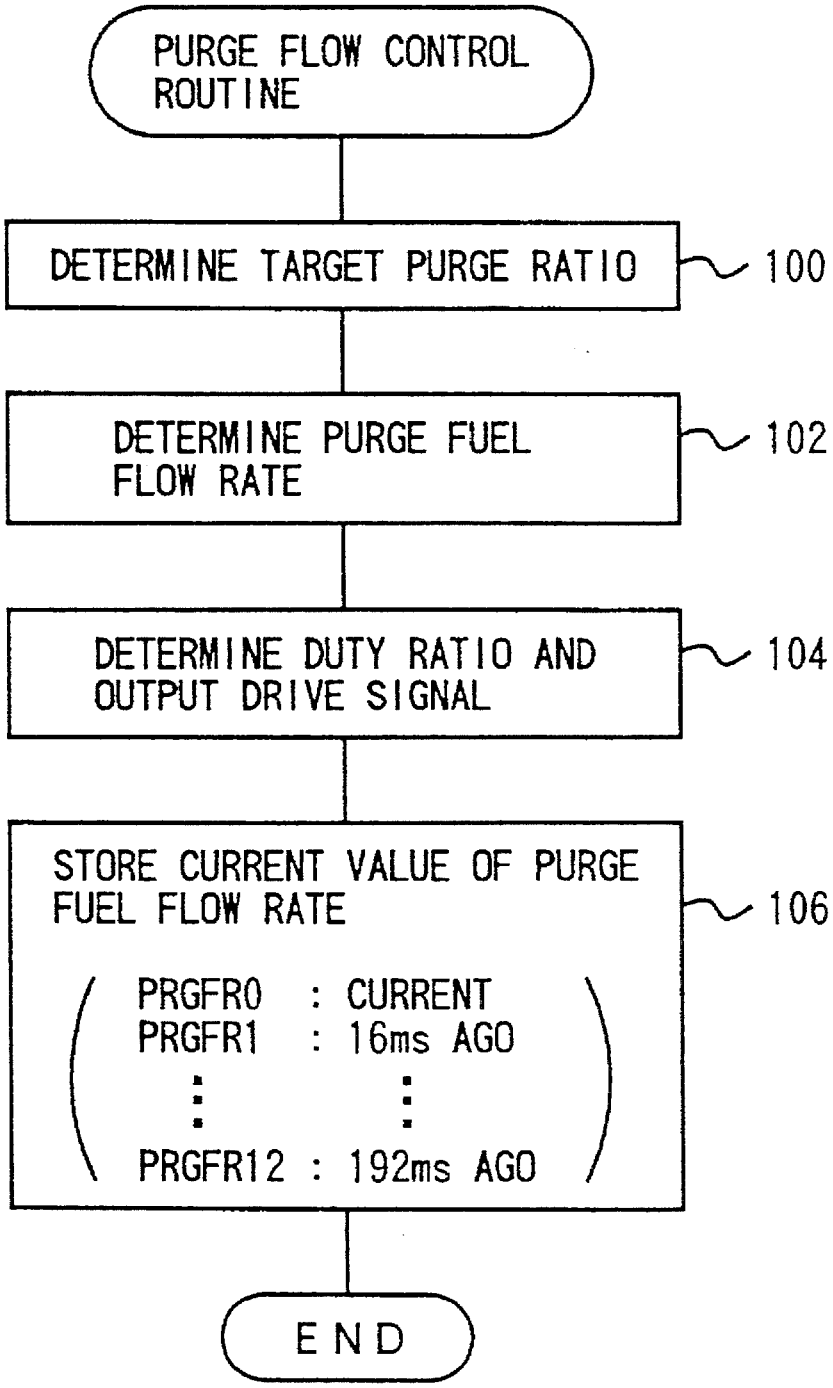
FIG. 2 is a flow chart for explaining a purge flow control routine executed by an electronic control unit of the engine in the first embodiment of the present invention.
Figure 3:
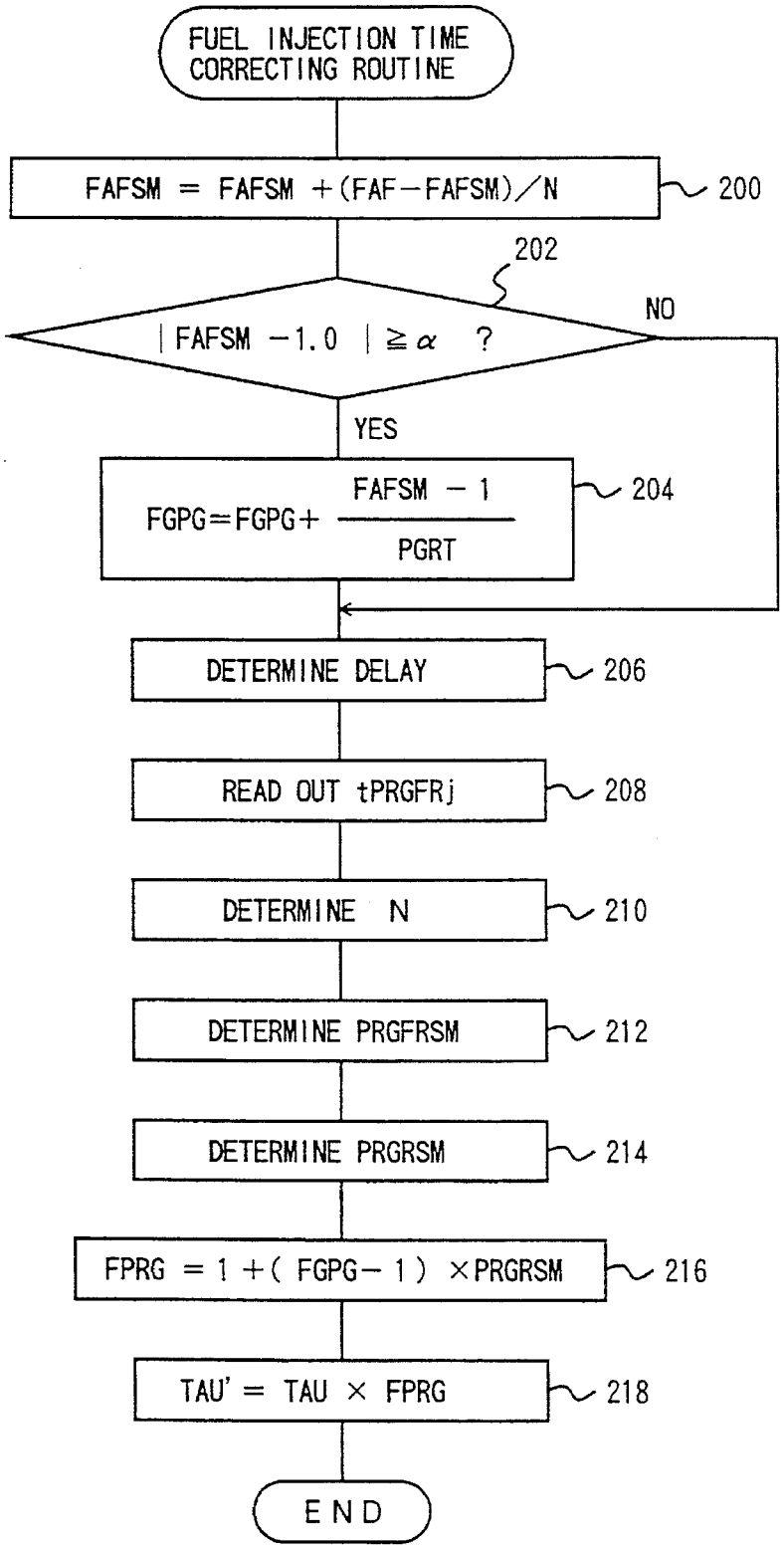
FIG. 3 is a flow chart for explaining a fuel injection time correcting routine executed by the electronic control unit in the first embodiment.

FIG. 2 shows a purge flow control routine executed by the ECU 30 of the engine 10 in the first embodiment. FIG. 3 shows a fuel injection time correcting routine executed by the ECU 30 in the first embodiment. A control program is stored in the ROM 32, and the CPU 34 executes the purge flow control routine of FIG. 2 and the fuel injection time correcting routine in accordance with the stored control program.

In a conventional engine provided with an evaporated fuel purge system, the air-fuel ratio of the engine is controlled by maintaining the ratio of the purge fuel amount (discharged from the evaporated fuel purge system to the engine) to the intake air amount at a constant value. In other words, the air-fuel ratio control of the conventional engine is effective only when the ratio of the evaporated fuel amount to the intake air amount can be maintained at a constant value.

Figures 5A, 5B, 5C, 5D:
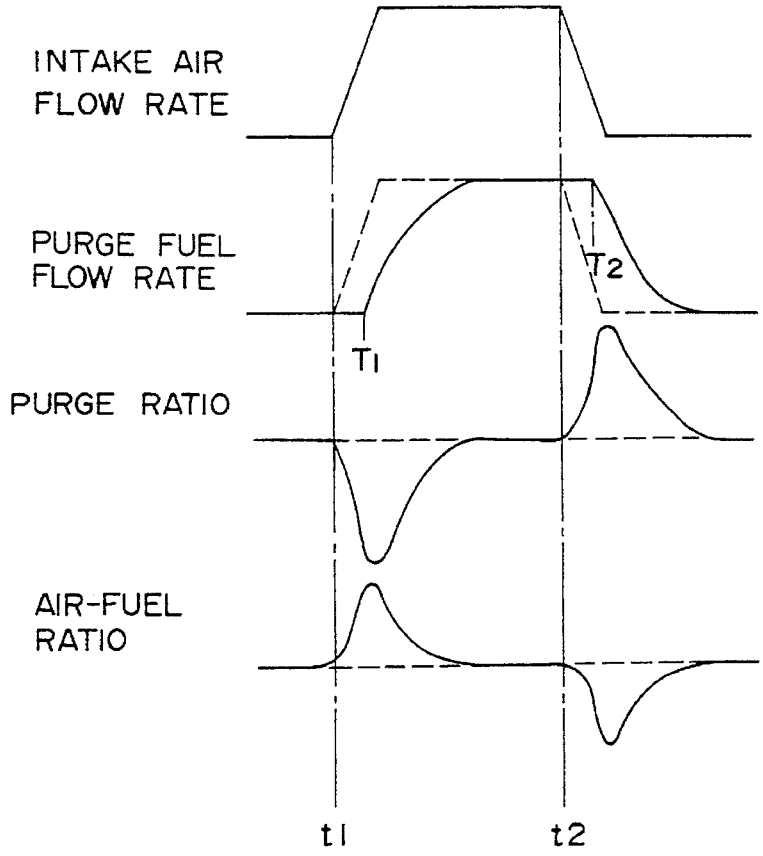
FIGS. 5A through 5D are time charts showing the operating conditions of the engine when the intake air flow rate abruptly fluctuates.

However, it is difficult to always maintain the ratio of the evaporated fuel amount to the intake air amount at a constant value. To explain this, a case in which the flow rate of the intake air to the engine has abruptly changed will be taken into consideration. As shown in FIG. 5A, the intake air flow rate abruptly increases at a time t1 and abruptly decreases at a time t2. In order to maintain the ratio of the purge fuel amount to the intake air amount at a constant value in the above case, it is necessary to make the purge fuel flow rate quickly change at the times t1 and t2 according to the fluctuation of the intake air flow rate, as indicated by a dotted line in FIG. 5B.

The purge control valve 27 responds to a drive signal supplied from the ECU 30 after a delay. This delay is a period of time from the issue of the drive signal to the arrival of corresponding purge fuel at the engine 10. The canister 21 has a considerable resistance to the flow of air within the purge line 26. For such reasons, the purge fuel flow rate changes as indicated by a solid line in FIG. 5B, in the above case. The actual change in the purge fuel flow rate, indicated by the solid line, has a delay from the issue of a purge control valve drive signal, and the change is different from that of the ideal purge fuel flow rate indicated by the dotted line in FIG. 5B.

As indicated by a solid line in FIG. 5C, the ratio of the purge fuel amount to the intake air amount changes irregularly in the above case. It is impossible to maintain the ratio of the purge fuel amount to the intake air amount at a constant value in the above case.

The air-fuel ratio control apparatus in the first embodiment of the present invention estimates the actual purge ratio, which is the ratio of the purge fuel amount to the intake air amount, by detecting the actual intake air flow rate in FIG. 5A and the actual purge fuel flow rate in FIG. 5B. The air-fuel ratio control apparatus carries out a fuel injection time correcting procedure based on the estimated purge ratio, so as to set the air-fuel ratio of the engine to appropriate values even when the intake air flow rate considerably fluctuates. It is possible to maintain the actual air-fuel ratio of the engine at appropriate values when the intake air flow rate fluctuates considerably.

The purge flow control routine in FIG. 2 is executed by the ECU 30 as interrupts are issued to the ECU 30 at every 16 ms (milliseconds). That is, the purge flow control routine in FIG. 2 is repeatedly performed at time intervals of 16 ms.

At the start of the purge flow control routine in FIG. 2, step 100 determines a target purge ratio based on the operating conditions of the engine 10. The target purge ratio is calculated based on the sensed operating conditions of the engine 10, and it is a basic value indicating the ratio of the purge fuel flow rate to the intake air flow rate.

Step 102 determines a purge fuel flow rate which realizes the target purge ratio at step 100. The purge fuel flow rate is determined based on an intake air flow rate QA multiplied by the target purge ratio at step 100. The intake air flow rate QA is calculated based on a sensed intake air pressure, supplied from the intake air pressure sensor 17, and on a sensed engine temperature, supplied from the engine temperature sensor 39.

Step 104 determines a duty ratio of the purge control valve 27 based on the purge fuel flow rate calculated at step 102. Step 104 generates a purge control valve drive signal which indicates an on-time of the purge control valve 27 within a duty cycle time, the on-time being equivalent to the duty ratio, and outputs the drive signal to the purge control valve 27 through the valve driving circuit 45. The purge control valve 27 is operated responsive to the duty ratio indicated by the purge control valve drive signal from the ECU 30, so as to realize the purge flow control as indicated by the dotted line in FIG. 5B.

Step 106 stores the current value of the purge fuel flow rate, determined at step 102, in the RAM 33 of the ECU 30. The purge flow control routine then ends. In the RAM 33 of the ECU 30, twelve purge fuel flow rate values, other than the current purge fuel flow rate value PRGFR0, which include a previous purge fuel flow rate value PRGFR1 determined 15 ms ago, . . . , a previous purge fuel flow rate value PRGFR12 determined 192 ms ago, are stored. By retrieving the RAM 33 of the ECU 30, one of those purge fuel flow rate values can be retrospectively detected.

The fuel injection time correcting routine in FIG. 3 is executed by the ECU 30 as interrupts are periodically issued to the ECU 30. In this routine, a corrected fuel injection time is determined based on one of the purge fuel flow rate values stored in the RAM 33.

At the start of the fuel injection time correcting routine in FIG. 3, step 200 calculates a current value of an average air-fuel ratio correcting factor FAFSM in accordance with the following equation.

$$FAFSM=FAFSM(o)+(FAF-FAFSM(o))/N \quad (1)$$

where FAFSM(o) is a previous value of the average air-fuel ratio correcting factor, FAF is a feedback correcting factor set in an air-fuel ratio feedback routine, and N is a weighting factor.

The average air-fuel ratio correcting factor FAFSM indicates an average of the feedback correcting factor FAF for a relatively long term. When the air-fuel mixture supplied to the engine can be made accurate to the stoichiometric value, the FAFSM is around 1.0. When the air-fuel mixture becomes rich, the FAFSM is smaller than 1.0. When the air-fuel mixture becomes lean, the FAFSM is greater than 1.0. In other words, the FAFSM indicates a deviation of the current air-fuel ratio from the stoichiometric air-fuel ratio.

Step 202 detects whether or not the absolute value |FAFSM−1.0| is greater than a reference value α. The reference value α is equal to, for example, 0.02. Whether or not the air-fuel mixture, currently supplied to the engine 10, is excessively rich or lean is detected at this step.

If the result at step 202 is affirmative, the air-fuel mixture is detected to be excessively rich or lean. Step 204 is performed in this case. Step 204 determines a purge fuel concentration factor FGPG for unit purge ratio in accordance with the following equation.

$$FGPG=FGPG(o)+(FAFSM-1.0)/PGRT \quad (2)$$

where FGPG(o) is a previous value of the purge fuel concentration factor determined at a previous cycle, and PGRT is a target purge ratio set in the purge flow control routine described above. When the purge fuel flow rate reaches a steady state, the target purge ratio PGRT is equal to the ratio of a purge fuel flow rate, determined from the opening of the purge control valve 27, to an intake air flow rate, estimated from an output of the intake air pressure sensor 17. At step 204, the FGPG can be updated to the appropriate value when the air-fuel mixture is detected to be excessively rich or lean.

If the result at step 202 is negative, the air-fuel mixture is detected to be within the range in which the criteria is met. In this case, the above step 204 is not performed and step 206 is performed.

Step 206 determines a delay on the purge control valve 27. The delay is a period of time from the issue of a purge control valve drive signal to the arrival of corresponding purge fuel at the engine 10. This time period corresponds to a period of time indicated by the times t1 and T1 or by the times t2 and T2 in FIG. 5B. The delay can be calculated by adding a fuel flow time, needed for the purge fuel within the purge control valve 27 to reach the engine 10, to a response delay intrinsic to the purge control valve 27. The fuel flow time mentioned above depends upon the negative pressure in the intake passage of the engine, and the response delay mentioned above is constant. That is, the delay can be determined as a function of the engine speed Ne.

Figure 4A:
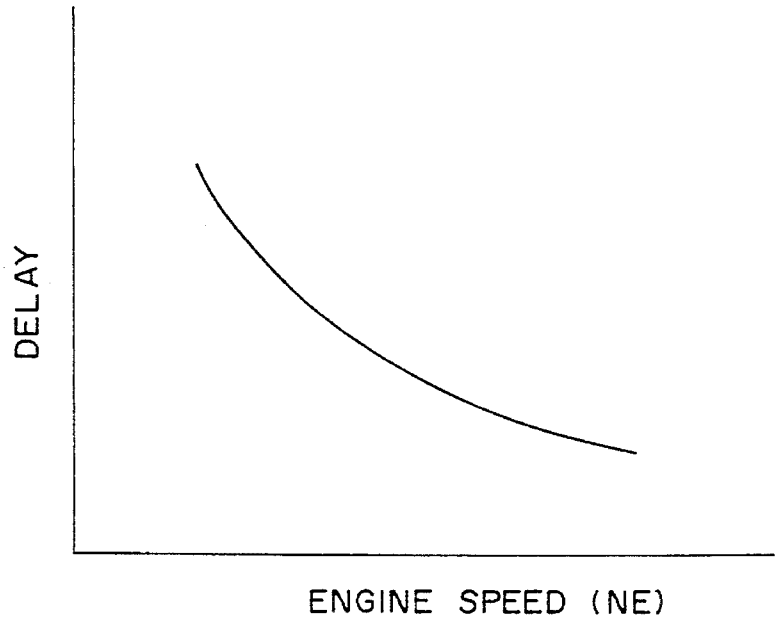
FIGS. 4A and 4B are diagrams showing maps used in the fuel injection time correcting routine in FIG. 3.

In the first embodiment described above, a map, indicating the relationship between the engine speed and the delay as shown in FIG. 4A, is stored in the ROM 32. At step 206, a value of the delay on the purge control valve 27 can be read out from the map stored in the ROM 32 in accordance with the sensed engine speed at the instant.

Step 208 reads out a previous purge fuel flow rate value tPRGFRj from the RAM 33 in accordance with the delay determined at step 206. As described above, a set of previous purge fuel flow rate values is stored in the RAM 33. One of the previous purge fuel flow rate values, which corresponds to a time, prior to the instant, equivalent to the delay at step 206, is read out from the RAM 33. The previous purge fuel flow rate tPRGFRj, read out at step 208, corresponds to the flow rate of purge fuel included in the air-fuel mixture that is supplied to the engine 10 at the instant.

Step 210 determines a weighting factor N. In order to estimate the flow rate of the actual purge fuel, included in the air-fuel mixture to the engine, with accuracy, it is necessary to calculate a weighted average of the current purge fuel flow rate value and a previous purge fuel flow rate value by using the weighting factor N determined at this step.

Step 212 estimates the actual purge fuel flow rate by determining a value of PRGFRSM in accordance with the following equation.

$$PRGFRSM=PRGFRSM(o)+(tPRGFRj-PRGFRSM(o))/N \quad (3)$$

where PRGFRSM(o) is a previous value of the PRGFRSM determined at a previous cycle, and N is the weighting factor determined at step 210.

Figure 4B:
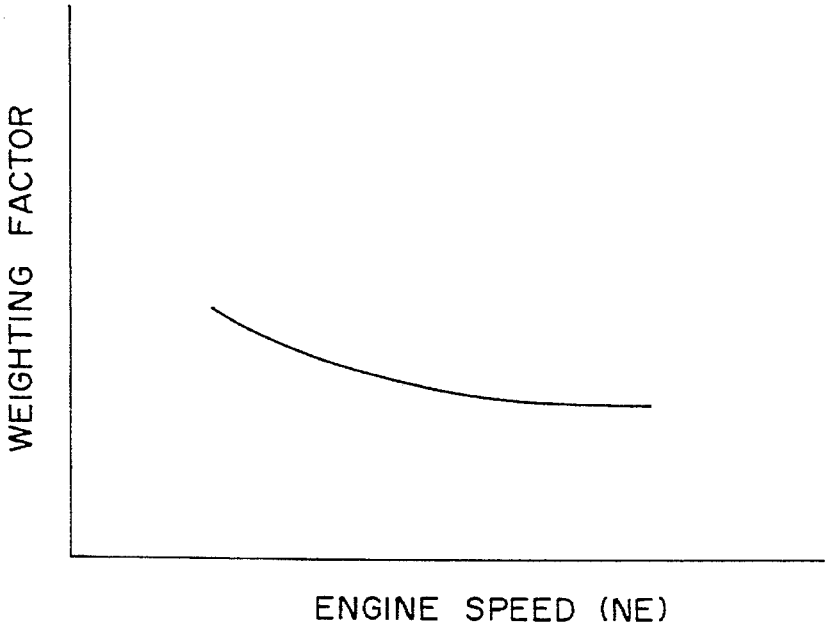

In the first embodiment described above, a second map, indicating the relationship between the engine speed and the weighting factor as shown in FIG. 4B, is stored in the ROM 32. At step 212, a value of the weighting factor N can be read out from the second map stored in the ROM 32 in accordance with a value of the engine speed at the instant.

After the estimated purge fuel flow rate PRGFRSM is acquired, step 214 determines a value of the actual purge ratio PRGRSM in accordance with the following equation.

$$PRGRSM=PRGFRSM/QA \quad (4)$$

where PRGFRSM is the value of the estimated purge fuel flow rate at step 212, and QA is a value of the intake air flow rate based on a signal from the intake air pressure sensor 17. The actual purge ratio PRGRSM, determined at step 214, indicates the ratio of the actual purge fuel flow rate to the actual intake air flow rate with respect to the engine 10.

After the actual purge ratio PRGRSM is acquired, step 216 calculates a correction coefficient FPRG in accordance with the following equation.

$$FPRG=1+(FGPG-1)\times PRGRSM \quad (5)$$

where PRGRSM is the value of the actual purge ratio determined at step 214. (FGPG −1)×PRGRSM, in the above equation (5), indicates the magnitude of a deviation of the air-fuel ratio of the actual air-fuel mixture produced by the actual purge fuel flow.

The correction coefficient calculated at step 216 varies depending on the deviation of the air-fuel ratio of the actual air-fuel mixture which deviation is in accordance with the actual purge ratio. If the air-fuel ratio is equal to the stoichiometric air-fuel ratio, the correction coefficient FPRG is equal to 1.0. When the actual air-fuel mixture becomes lean, the correction coefficient FPRG is greater than 1.0. On the other hand, when the actual air-fuel mixture becomes rich, the correction coefficient FPRG is smaller than 1.0.

Step 218 calculates a corrected fuel injection time TAU' by multiplying a fuel injection time TAU by the correction coefficient FPRG. This is indicated by the following equation (6). The fuel injection time TAU is set in a fuel injection control procedure.

$$TAU'=TAU\times FRPG \quad (6)$$

After the corrected fuel injection time TAU' is determined at step 218, the fuel injection time correcting routine in FIG. 3 ends. The ECU 30 supplies a fuel injection valve drive signal to the fuel injection valve 14 through the valve driving circuit 44. The fuel injection valve drive signal is generated in accordance with the corrected fuel injection time TAU'.

Figure 6:
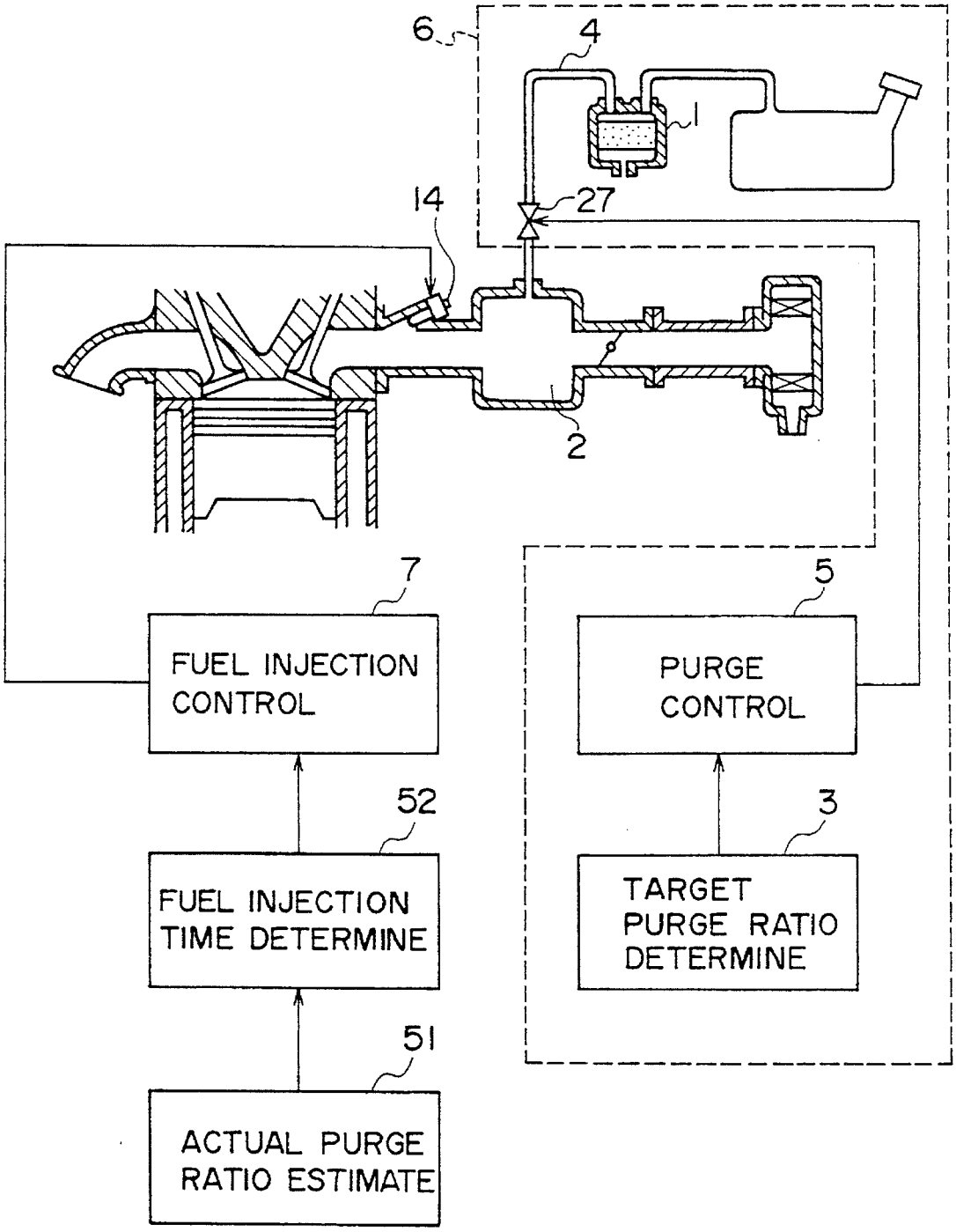
FIG. 6 is a diagram showing an air-fuel ratio control apparatus in the first embodiment of the present invention.

FIG. 6 shows an air-fuel ratio control apparatus in the first embodiment of the present invention. The air-fuel ratio control apparatus comprises a target purge ratio determining part 3, a purge control part 5, an actual purge ratio estimating part 51, a fuel injection time determining part 52, and a fuel injection control part 7.

In FIG. 6, an evaporated fuel purge system 6 includes a canister 1 for temporarily storing evaporated fuel from a fuel tank, and supplies the evaporated fuel to an intake passage 2 of the engine through the purge control valve 27. The purge control valve 27 is arranged at an intermediate portion in a purge line 4 between the canister 1 and the intake passage 2.

The target purge ratio determining part 3 performs the step 100 of the purge flow control routine in FIG. 2. The part 3 determines a target purge ratio in accordance with operating conditions of the engine.

The purge control part 5 performs the steps 102 through 106 of the purge flow control routine in FIG. 2. The purge control part 5 controls a flow rate of evaporated fuel, supplied from the evaporated fuel purge system 6 into the intake passage 2, by actuating the purge control valve 27 based on the target purge ratio determined by the target purge ratio determining part 3. The purge control part 5 stores an evaporated fuel flow rate of the purge control valve 27.

The fuel injection control part 7 generates a drive signal in accordance with a fuel injection time TAU, and controls an air-fuel ratio of an air-fuel mixture supplied to the engine by actuating the fuel injection valve 14 of the engine in accordance with the drive signal.

The estimating part 51 performs the steps 206 through 214 of the fuel injection time correcting routine in FIG. 3. The estimating part 51 estimates the ratio of an evaporated fuel flow rate to an intake air flow rate, based on operating conditions sensed from the engine and based on the stored evaporated fuel flow rate of the purge control part 5.

The fuel injection time determining part 52 performs the steps 216 and 218 of the fuel injection time correcting routine in FIG. 3. The fuel injection time determining part 52 determines a corrected fuel injection time TAU' based on the estimated ratio PRGRSM from the estimating part 51, and supplies the corrected fuel injection time to the fuel injection control part 7.

In the first embodiment described above, the air-fuel ratio control apparatus estimates the actual purge ratio of the engine when evaporated fuel is supplied from the evaporated fuel purge system into the intake passage of the engine. The air-fuel ratio control apparatus determines a corrected fuel injection time TAU' based on the estimated purge ratio PRGRSM. It is possible to maintain the air-fuel ratio of the air-fuel mixture to the engine at appropriate values even when the actual purge ratio of the engine changes considerably.

Next, a description will be given of an air-fuel ratio control apparatus in the second embodiment of the present invention.

In the engine 10 having the ECU 30, a fuel cut mode procedure is performed if the throttle valve 19 is abruptly closed at a high engine speed, in order to improve the fuel consumption. By performing the fuel cut mode procedure in response to the closed condition of the throttle valve 19, the amount of the purge fuel supplied to the intake passage and the amount of the fuel injected to the intake passage are reduced. However, at this time, the exhaust emission on the engine having the evaporated fuel purge system considerably deteriorates if the fuel cut mode procedure is performed at a high purge ratio. The air-fuel ratio control apparatus in the second embodiment is intended to suitably control the air-fuel ratio of the air-fuel mixture to the engine at this time.

FIGS. 7A through 7F show the operating conditions of the engine having the evaporated fuel purge system when a fuel cut control routine is executed by the ECU 30 under a condition in which the purge fuel flow considerably affects the operating conditions of the engine.

Figures 7A, 7B, 7C, 7D, 7E, 7F:
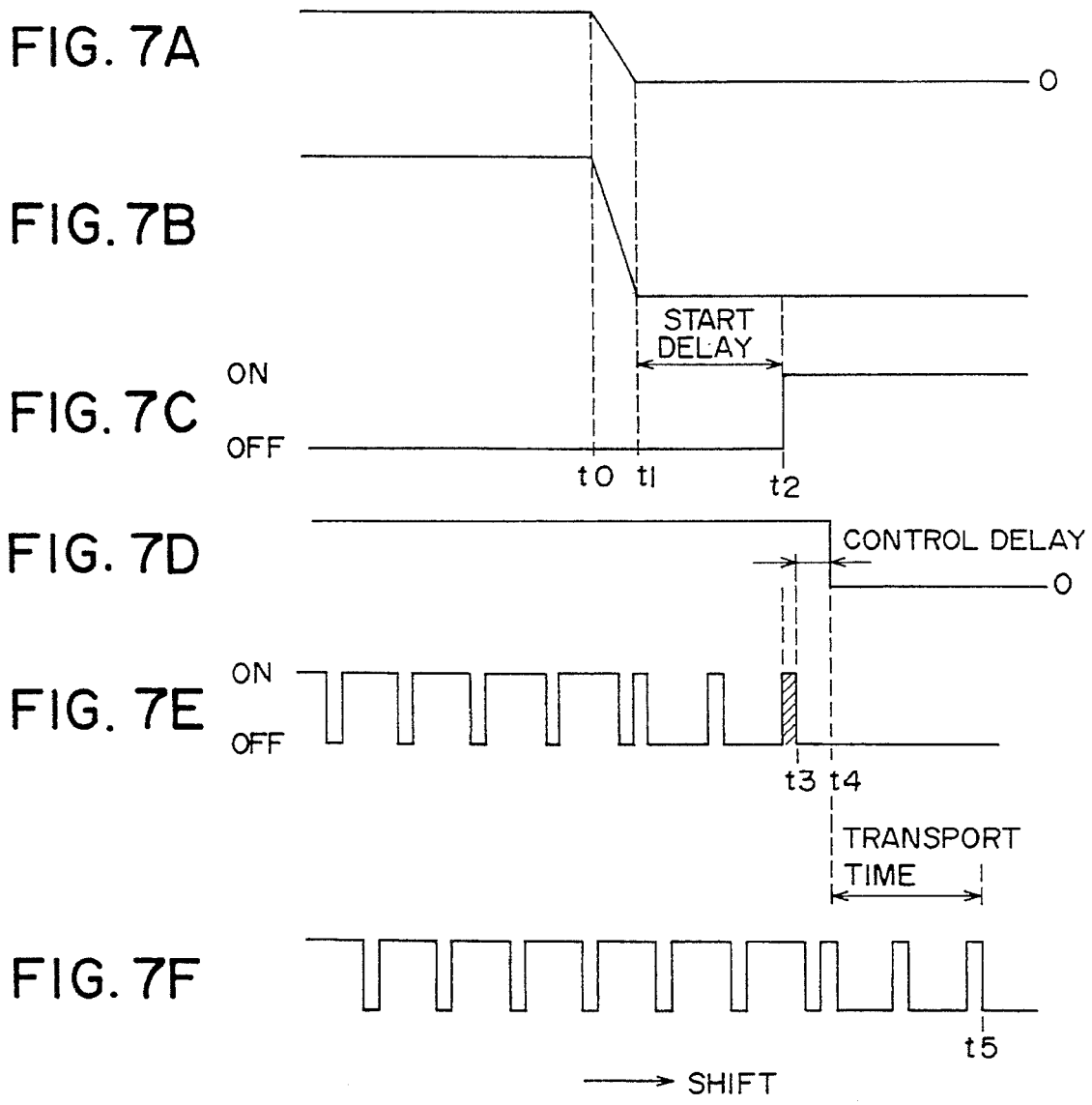
FIGS. 7A through 7F are time charts for explaining a delay at the start of the purge flow control routine.

FIG. 7A shows a change in the condition of the throttle valve 19 during the operation of the engine 10. In FIG. 7A, the throttle valve 19 is set to the closed condition within a period between times "t0" and "t1". The fuel cut control routine is started if the throttle valve 19 is in the closed condition at an engine speed higher than a given idling speed. The fuel cut control routine continues to be run until the engine speed is lower than or equal to the idling speed.

FIG. 7B shows a change in the intake air flow rate in accordance with the change in the throttle valve condition. After the time "t1" at which the throttle valve 19 has reaches the closed condition, the intake air flow rate converges at a prescribed flow rate which is needed to keep the engine at the idling speed. The fuel injection amount changes in accordance with the change in the throttle valve condition, similarly to the change in the intake air flow rate.

FIG. 7C shows a condition of a fuel cut flag. When the fuel cut flag is turned ON, the fuel cut control routine is started accordingly. When the fuel cut flag is turned OFF, the fuel cut control routine is finished. If the fuel cut control routine is started immediately when the throttle valve 19 is closed, the drivability deteriorates due to the impact on the operating conditions of the engine. To avoid this, the fuel cut flag is turned ON after a start delay (corresponding to a period between "t1" and "t2" in FIG. 7C) has elapsed since the sensing of the closed condition of the throttle valve 19. That is, the fuel cut flag is turned ON at the time "t2" after the start delay has elapsed since the sensing of the closed condition of the throttle valve 19. The fuel injection amount is set to the amount at the idling speed (the fuel cut flag is OFF) during the start delay between "t1" and "t2", and it is set to zero (the fuel cut flag is ON) after the time "t2".

In order to suitably control the air-fuel ratio of the air-fuel mixture to the engine having the evaporated fuel purge system in this case, it is desirable to set the actual purge ratio to zero at the time "t2" in response to the start of the fuel cut control routine.

FIG. 7E shows a change in the drive signal (the VSV voltage) in accordance with the change in the fuel cut flag, the drive signal being supplied from the ECU 30 to the purge control valve 27. The drive signal in FIG. 7E is changed to the OFF state at the time "t3", in response to the ON state of the fuel cut flag.

FIG. 7D shows a change in the purge ratio in accordance with the change in the drive signal supplied to the purge control valve 27. A control delay which corresponds to a period between "t3" and "t4" in FIG. 7D is needed to actually change the purge ratio to zero. After the control delay has elapsed since the OFF of the drive signal, the purge control valve 27 is set to the closed condition around the time "t4".

It is necessary to take into consideration a case in which a transport time of the purge fuel is needed. In the actual case, a transport time is needed to transport the evaporated fuel from the purge control valve 27 to the engine 10, this transport time corresponding to a period between "t4" and "t5". FIG. 7F shows a change in the drive signal (the VSV voltage) supplied to the purge control valve 27 in the actual case. The drive signal in FIG. 7F is shifted from the drive signal in FIG. 7E as long as the transport time. Therefore, the engine having the evaporated fuel purge system, under the condition in which the purge fuel flow considerably affects the operating conditions, has a problem in that turning the purge control valve 27 OFF in response to the closed condition of the throttle valve 19 delays as long as the period between "t2" and "t5".

As described above, when the intake air flow rate considerably fluctuates, especially when the fuel cut mode procedure is performed in response to the closed-condition of the throttle valve 19, it is difficult to stop the supply of the evaporated fuel from the evaporated fuel purge system into the engine at an appropriate timing. The air-fuel mixture to the engine in this case may be excessively rich since the additional purge fuel is supplied to the engine in the start delay, causing the exhaust emission to deteriorate.

It is desirable to minimize the start delay, which corresponds to a period between the closed condition of the throttle valve and the on-state of the fuel cut flag. FIGS. 8A through 8E show the operating conditions of the engine to which the second embodiment of the present invention is applied, when a fuel cut mode procedure is performed by the ECU under a condition in which the purge fuel flow does not considerably affect the operating conditions of the engine.

Figures 8A, 8B, 8C, 8D, 8E:
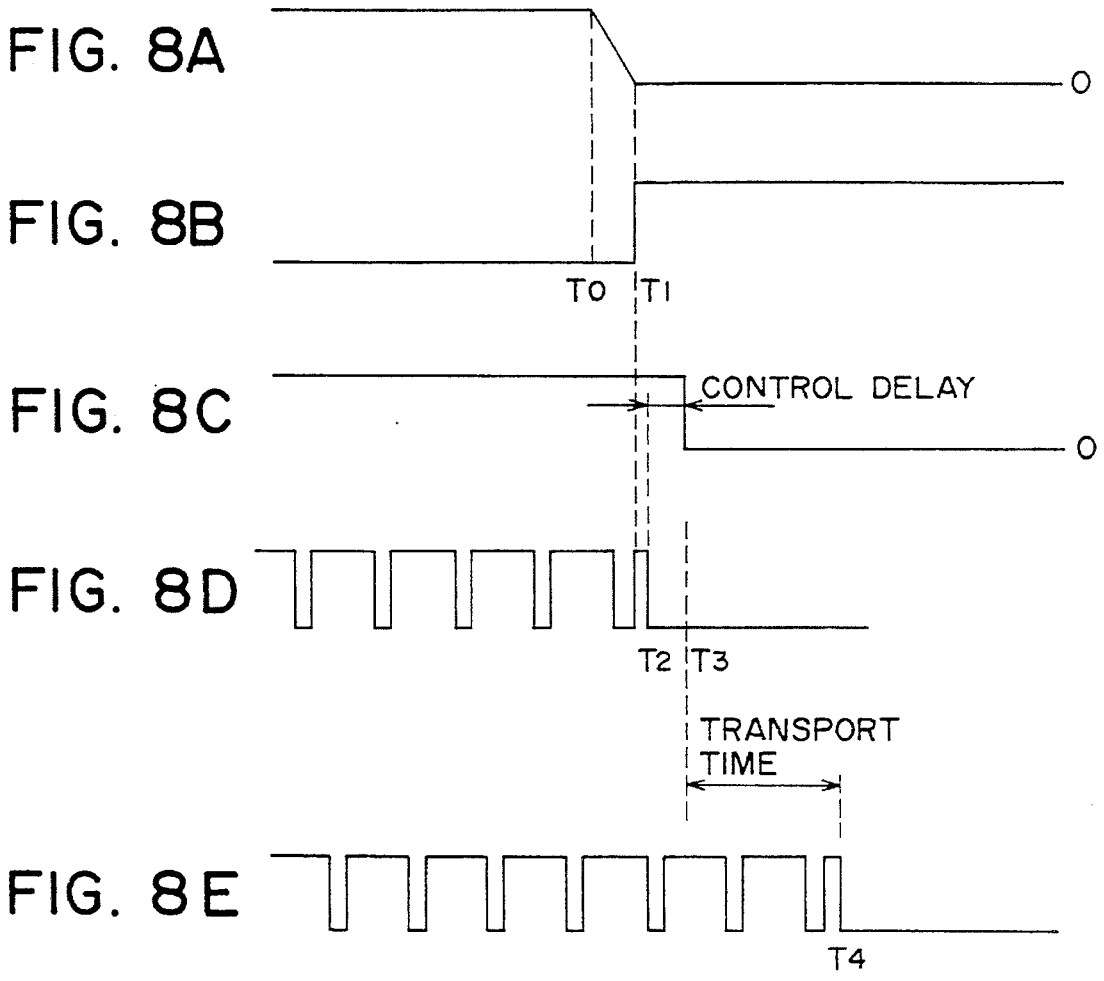
FIGS. 8A through 8E are time charts for explaining operations of an air-fuel ratio control apparatus in the second embodiment of the present invention.

When the throttle valve 19 is set to the closed condition within a period between "T0" and "T1" in FIG. 8A, the fuel cut flag in FIG. 8B is turned ON at "T1" immediately after the closed condition of the throttle valve 19 is set.

According to the second embodiment, the drive signal (the VSV voltage) in FIG. 8D, supplied to the purge control valve 27, is changed to the OFF state at "T2" in response to the ON state of the fuel cut flag. The purge ratio in FIG. 8C is changed to zero at "T3" since the purge control valve 27 is set to the closed condition around "T3" after a control delay. The control delay corresponds to a period between "T2" and "T3".

When the transport time described above is taken into consideration, the drive signal in FIG. 8E is shifted from the drive signal in FIG. 8D as long as the transport time. The transport time corresponds to a period between "T3" and "T4" in FIG. 8E.

Figure 9:
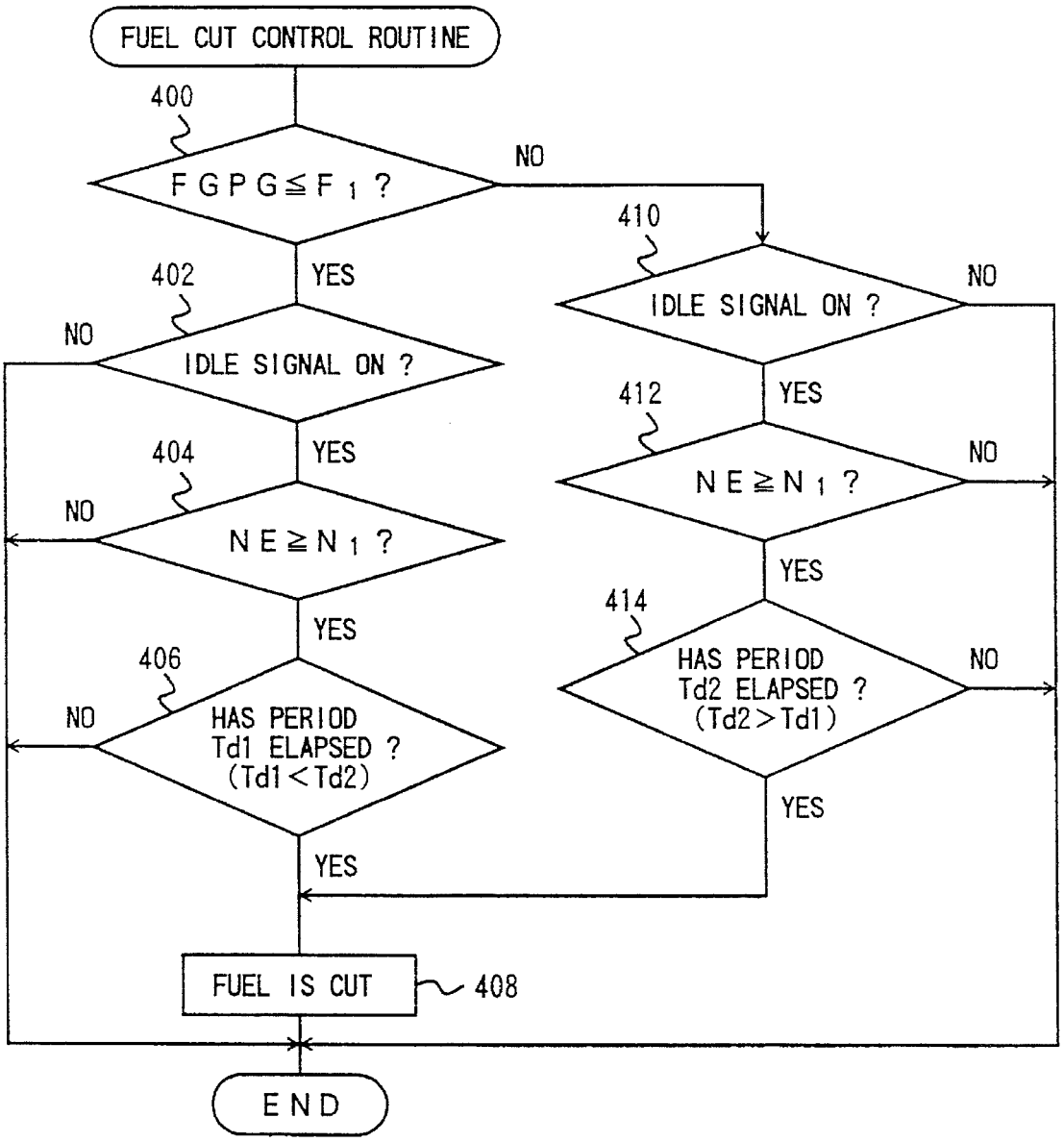
FIG. 9 is a flow chart for explaining a fuel cut control routine executed by the electronic control unit in the second embodiment.

FIG. 9 shows a fuel cut control routine executed by the ECU 30 in the second embodiment. The fuel cut control routine in FIG. 9 is executed by the ECU 30 in the second embodiment as interrupts are periodically issued to the ECU 30. The fuel cut control routine is intended to prevent the exhaust emission from deteriorating when the fuel cut mode procedure is being performed, by changing the start delay of the purge control valve 27 so as to be in accordance with the value of the purge fuel concentration factor.

At the start of the fuel cut control routine in FIG. 9, step 400 detects whether or not the purge fuel concentration factor FGPG, calculated at step 204 in FIG. 3, is equal to or smaller than a given reference value F1.

When the result at step 400 is affirmative, it can be determined that the air-fuel mixture to the engine is considerably affected by the purge fuel flow into the engine. In that case, steps 402 through 406 are performed. On the other hand, when the result at step 400 is negative, it can be determined that the air-fuel mixture to the engine is not considerably affected by the purge fuel flow into the engine. In that case, steps 410 through 414 are performed.

Step 402 detects whether or not an idle signal is supplied from the throttle switch 38 to the ECU 30. The idle signal from the throttle switch 38 is supplied to the ECU 30 when the throttle valve 19 is detected to be in the closed condition. When the throttle valve 19 is not set to the closed condition, the fuel cut mode procedure has not to be performed. Thus, if the result at step 402 is negative, the routine in FIG. 9 ends.

If the result at step 400 is negative, step 410 is performed in the same manner as the above step 402.

If the result at step 402 is affirmative, the idle signal from the throttle switch 38 is detected at the ECU 30. Step 404 detects whether or not the engine speed Ne, sensed from the engine, is higher than or equal to a given reference speed N1. The fuel cut control procedure has to be started only when the engine is running in operating conditions in which the engine does not stall. When the engine speed is lower than the reference speed N1, the engine is likely to stall in the fuel cut control procedure. Thus, if the result at step 404 is negative, the routine in FIG. 9 ends.

If the result at step 410 is affirmative, step 412 is performed in the same manner as the above step 404.

If the result at step 404 is affirmative, the engine speed NE is detected to be higher than or equal to the reference speed N1. Step 406 detects whether or not a given first time period Td1, which is relatively short, has elapsed since the sensing of the idle signal from the throttle switch 38. That is, in order to suitably control the air-fuel ratio of the air-fuel mixture to the engine, it is necessary to start the fuel cut mode procedure within a relatively short period (Td1) from the sensing of the idle signal, when the air-fuel mixture to the engine is considerably affected by the purge fuel flow. The fuel cut condition at step 406 involves the first time period Td1, and it is satisfied within the relatively short period since the sensing of the idle signal. It is possible to set the first time period Td1 to 0.

If the result at step 406 is affirmative, the first time period Td1 has elapsed under the condition of FGPG≦F1 since the sensing of the idle signal. At this time, step 408 turns the fuel cut flag ON, and instructs the fuel injection valve 14 to cut the fuel injected, and closes the purge control valve 27 to cut the purge fuel supplied. At step 408, the fuel injected by the fuel injection valve 14 into the intake passage and the purge fuel supplied from the purge control valve 27 into the intake passage are cut. On the other hand, if the result at step 406 is negative, the routine in FIG. 9 ends.

If the result at step 412 is affirmative, the engine speed NE is detected to be higher than or equal to the reference speed N1. Step 414 detects whether or not a given second time period Td2, which is longer than the above first time period Td1 (Td2>Td1), has elapsed since the sensing of the idle signal from the throttle switch 38. That is, the fuel cut mode procedure is started within a relatively long time period from the sensing of the idle signal, when the air-fuel mixture to the engine is not considerably affected by the purge fuel flow. The fuel cut condition at step 414 involves the second time period Td2, and it is satisfied within a relatively long period since the sensing of the idle signal.

If the result at step 414 is affirmative, the time period T2 has elapsed under the condition of FGPG >F1 since the sensing of the idle signal from the throttle switch 38. At this time, the fuel injected by the fuel injection valve 14 into the intake passage and the purge fuel supplied from the purge control valve 27 into the intake passage are cut at step 408. On the other hand, if the result at step 414 is negative, the fuel cut control routine in FIG. 9 ends.

Accordingly, when the air-fuel mixture to the engine is considerably affected by the purge fuel flow (FGPG≦F1), the fuel cut mode procedure is started at an appropriate timing, thereby preventing the exhaust emission from deteriorating.

Figure 10:
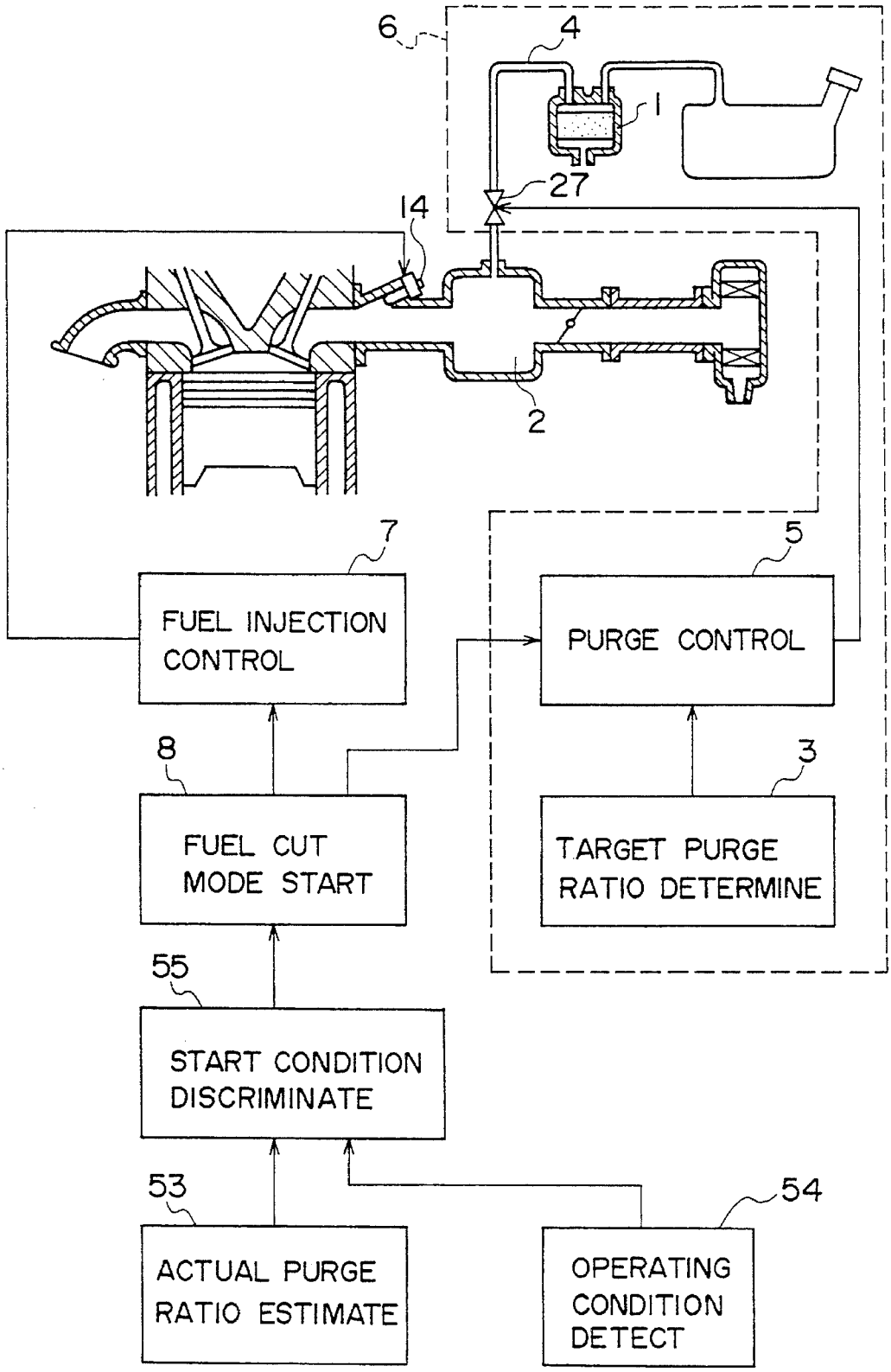
FIG. 10 is a diagram showing an air-fuel ratio control apparatus in the second embodiment.

FIG. 10 shows an air-fuel ratio control apparatus in the second embodiment of the present invention. In FIG. 10, the parts which are the same as those corresponding parts in FIG. 6 are designated by the same reference numerals.

The air-fuel ratio control apparatus in the second embodiment comprises the target purge ratio determining part 3, the purge control part 5, an actual purge ratio estimating part 53, an operating condition detecting part 54, a start condition discriminating part 55, a fuel cut mode starting part 8, and the fuel injection control part 7.

In FIG. 10, the purge control part 5, the target purge ratio determining part 3, and the fuel injection control part 7 are essentially the same as those corresponding parts in FIG. 6. The target purge ratio determining part 3 determines a target purge ratio in accordance with operating conditions of the engine. The purge control part 5 controls a flow rate of evaporated fuel, supplied from the evaporated fuel purge system 6 to the intake passage 2, by actuating the purge control valve 27 based on the target purge ratio determined by the target purge ratio determining part 3. The purge control part 5 stores an evaporated fuel flow rate of the purge control valve 27. The fuel injection control part 7 generates a drive signal in accordance with a fuel injection time TAU, and controls an air-fuel ratio of an air-fuel mixture supplied to the engine by actuating the fuel injection valve 14 of the engine in accordance with the drive signal.

The fuel cut mode starting part 8 starts a fuel cut mode procedure of each of the fuel injection control part 7 and the purge control part 5 in accordance with an on-state of a fuel cut flag.

The operating condition detecting part 54 detects that the engine is operating in operating conditions in which the fuel cut mode procedure can be started.

The purge ratio estimating part 53 estimates the purge ratio of an evaporated fuel flow rate to an intake air flow rate based on a sensed engine speed and a sensed intake air flow rate of the engine and based on the stored evaporated fuel flow rate of the purge control part 5.

The start condition discriminating part 55 turns on the fuel cut flag after a first period (Td1) has elapsed from the end of the detection by the operating condition detecting part 54 when an estimated purge ratio (FGPG) of the purge ratio estimating part 53 is equal to or smaller than a given reference value (F1), so that the fuel cut mode starting part 8 starts the fuel cut mode procedure. The start condition discriminating part 55 turns on the fuel cut flag after a second period (Td2) has elapsed from the end of the detection by the operating condition detecting part 54 when the estimated purge ratio (FGPG) is greater than the given reference value (F1), so that the fuel cut mode starting part 8 starts the fuel cut mode procedure. The first period (Td1) is shorter than the second period (Td2).

In the second embodiment described above, the sensing of the idle signal from the throttle switch 38 (or the throttle valve 19 is abruptly closed) is one of the fuel cut starting conditions. The present invention is applicable to the case in which the comparison of the basic fuel injection time TAU with a minimum fuel injection time TAUmin is used instead of the sensing of the idle signal.

FIGS. 11A through 11F show the operating conditions of the internal combustion engine to which a modification of the second embodiment is applied.

Figures 11A, 11B, 11C, 11D, 11E, 11F:
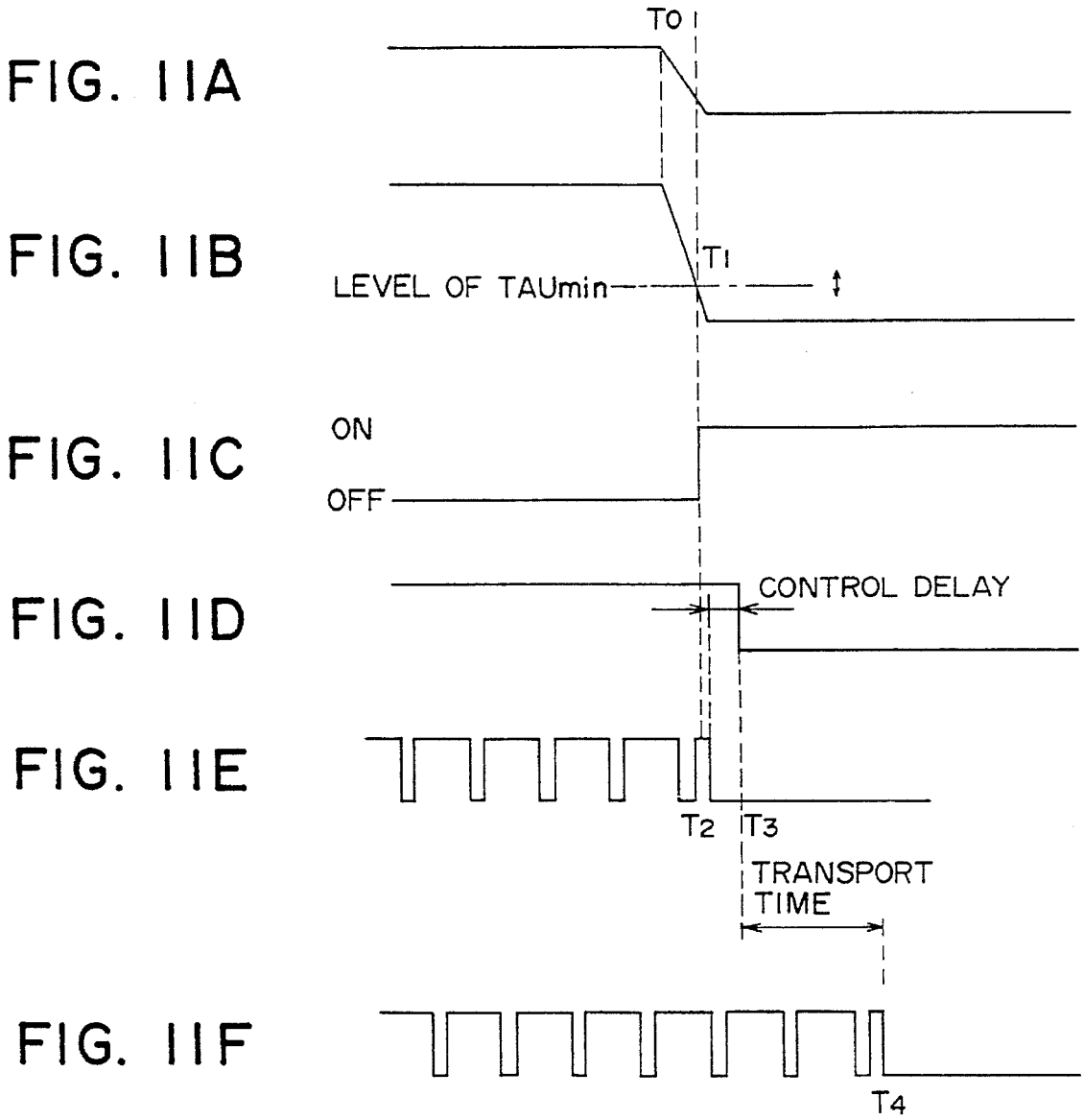
FIGS. 11A through 11F are time charts for explaining operations of another air-fuel ratio control apparatus in the second embodiment.

When the throttle valve 19 is abruptly closed within a period between "T0" and "T1" in FIG. 11A, the basic fuel injection time TAU in FIG. 11B is abruptly reduced in accordance with the closed condition of the throttle valve 19. Whether or not the basic fuel injection time TAU is lower than the TAUmin is detected by the engine control unit in this embodiment. If the condition of TAU<TAUmin is detected, the fuel cut mode procedure is started. The operating conditions of the engine in FIGS. 11C through 11F are the same as in the time charts in FIGS. 8B through 8E, respectively, and a description thereof will be omitted.

In the modification of the second embodiment mentioned above, when the air fuel mixture is considerably affected by the purge fuel flow (FGPG≦F1), the basic fuel injection time TAU is compared with a first minimum fuel injection time TAUmin1, which is relatively great, in order to start the fuel cut mode procedure at an appropriate timing. On the other hand, when the air fuel mixture is not considerably affected by the purge fuel flow (FGPG>F1), the basic fuel injection time TAU is compared with a second fuel injection time TAUMin2, which is smaller than the TAUmin1, in order to start the fuel cut mode procedure at an appropriate timing.

Figure 12:
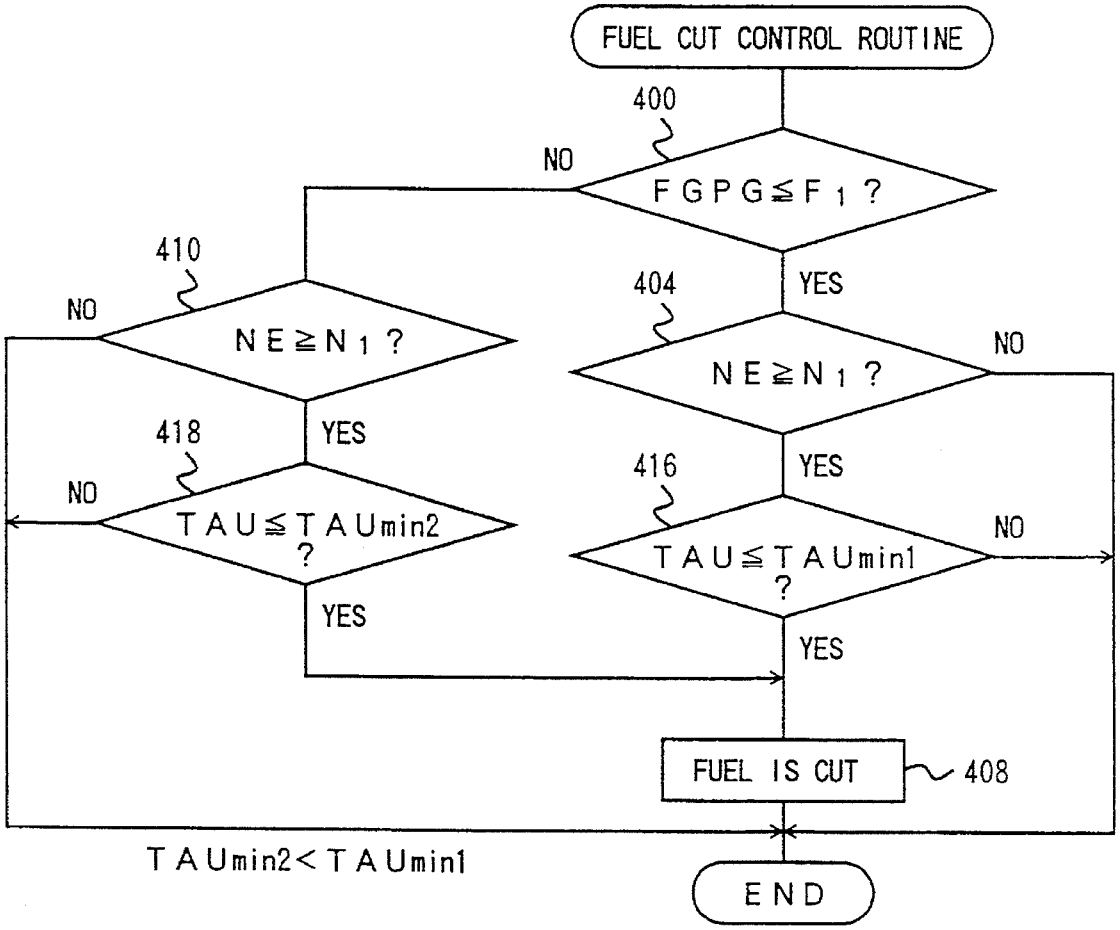
FIG. 12 is a flow chart for explaining another fuel cut routine executed by the electronic control unit of the air-fuel ratio control apparatus in FIGS. 11A through 11F.

FIG. 12 shows a fuel cut control routine executed by the ECU 30 in the modification of the second embodiment. The fuel cut control routine in FIG. 12 is executed by the ECU 30 as interrupts are periodically issued to the ECU 30. The fuel cut control routine is intended to prevent the exhaust emission from deteriorating when the fuel cut mode procedure is being performed. In FIG. 12, the steps which are the same as those corresponding steps in FIG. 9 are designated by the same reference numerals, and a description thereof will be omitted.

In the fuel cut control routine in FIG. 12, when the air-fuel mixture to the engine is considerably affected by the purge fuel flow (FGPG≦F1), steps 404 and 416 are performed. On the other hand, when the air-fuel mixture is not considerably affected by the purge fuel flow (FGPG>F1), steps 410 and 418 are performed.

Step 416 detects whether or not the basic fuel injection time TAU is equal to or smaller than the first minimum fuel injection time TAUmin1, which is relatively great. If the result at step 416 is affirmative, the fuel cut mode procedure is performed at step 408. As the TAUmin1 is set to a relatively large value, the fuel cut mode procedure is started quickly without delay. Thus, when the air-fuel mixture to the engine is considerably affected by the purge fuel flow (FGPG≦F1), the fuel cut mode procedure is started at an appropriate timing, thereby preventing the exhaust emission and the drivability from deteriorating.

Step 418 detects whether or not the basic fuel injection time TAU is equal to or smaller than the second minimum fuel injection time TAUmin2, which is smaller than the TAUmin1. If the result at step 418 is affirmative, the fuel cut mode procedure is performed at step 408.

Next, a description will be given of an air-fuel ratio control apparatus in the third embodiment of the present invention.

Figure 13:
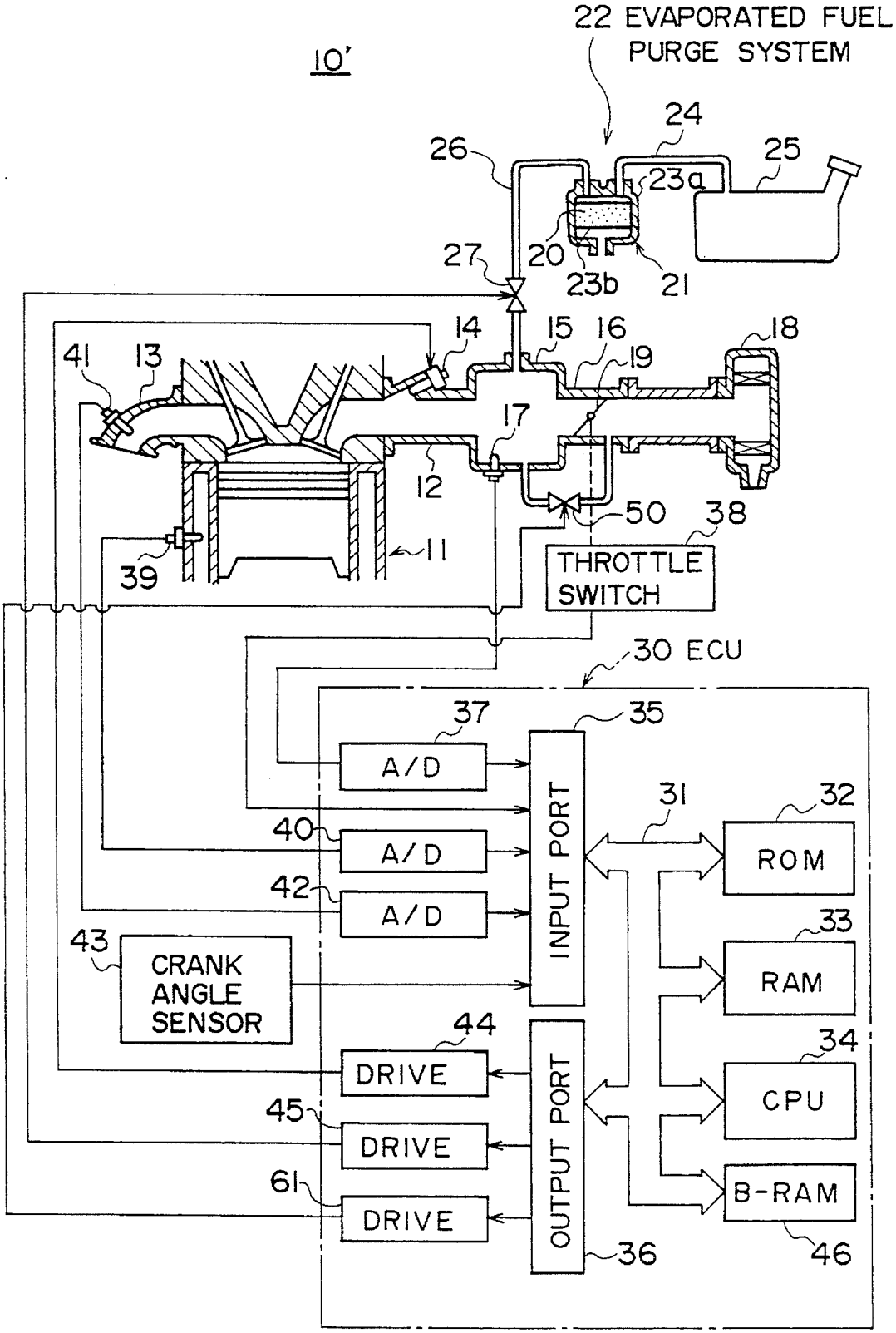
FIG. 13 is a diagram showing another internal combustion engine to which the present invention is applied.

FIG. 13 shows a different internal combustion engine to which the third embodiment of the present invention is applied. In FIG. 13, the parts which are the same as those corresponding parts in FIG. 1 are designated by the same reference numerals.

The internal combustion engine 10' in FIG. 13 is essentially the same as the internal combustion engine 10 in FIG. 1, except that the engine 10' comprises an ISCV (idle speed control valve) 50 arranged in a bypass passage, and a valve driving circuit 61 incorporated into the ECU 30. The bypass passage of the ISCV 50 is connected to the intake passage around the throttle valve 19. The valve driving circuit 61 is connected at one end to the output port 36 of the ECU 30, and it is connected at the other end to the ISCV 50. A drive signal, generated under the control of the CPU 34, is supplied to the ISCV 50 through the valve driving circuit 61.

When the throttle valve 19 is set to the closed condition, the engine is in an idling condition. The ISCV 50 at this time supplies a certain amount of air to the intake passage through the bypass passage, to make the idling condition of the engine stable.

If the throttle valve 19 is closed during the operation of the engine at a high intake air flow rate and then no air is supplied to the intake passage, the engine 10' is abruptly braked and the drivability considerably deteriorates. In order to reduce the impact on the engine, the ISCV 50 is used in the engine 10' as a dashpot valve for keeping the flow of intake air into the intake passage when the throttle valve 19 is closed. Generally, the intake air flow rate achieved by the ISCV 50 is a function of the intake air flow rate sensed from the engine immediately before the closed condition of the throttle valve 19 is sensed.

In the air-fuel ratio control apparatus in the third embodiment, a map indicating the relationship between the ISCV drive signal duty ratio and the intake air flow rate is stored. A value of the duty ratio of the ISCV drive signal is read out from the map based on the sensed intake air flow rate, and a drive signal indicating the read duty ratio value is supplied to the ISCV 50 to realize the dashpot valve mentioned above.

Figure 14A:
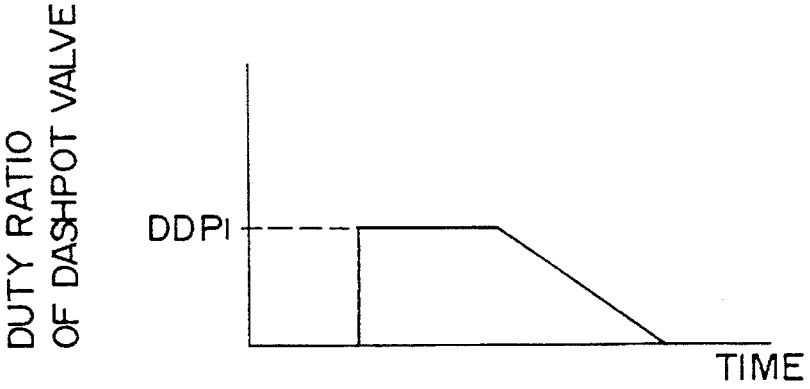
FIGS. 14A and 14B are time charts for explaining operations of a dash pot valve of the engine in FIG. 13.
Figure 14B:
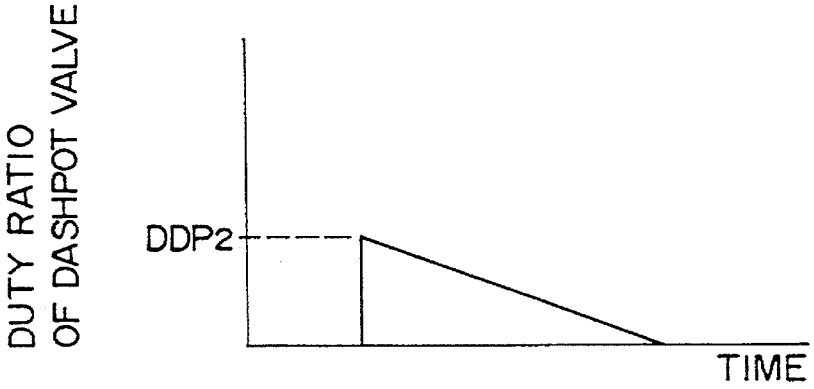

FIGS. 14A and 14B show two methods of actuating the ISCV 50 of the engine 10' in FIG. 13. In FIG. 14A, a drive signal used in one of the two methods to actuate the ISCV 50 is shown, the duty ratio at a start time is set to a duty ratio value DDP1, which is read from the map, and the duty ratio is kept within a certain period, and then decreases to zero at a given decreasing rate. In FIG. 14B, a drive signal used in the other method to actuate the ISCV 50 is shown, the duty ratio at a start time is set to a duty ratio value DDP2, which is read from the map, and the duty ratio decreases to zero at a give decreasing rate. When one of the methods is used, the amount of intake air, which is equivalent to the are under the drive signal chart indicated in one of FIGS. 14A and 14B is supplied to the intake passage from the ISCV 50 after the throttle valve 19 is closed.

As described above, when the throttle valve 19 is abruptly closed during the supply of evaporated fuel from the evaporated fuel purge system to the intake passage, the purge fuel flow rate becomes excessive. The air-fuel mixture to the engine becomes excessively rich due to the purge fuel flow, which will cause the exhaust emission to deteriorate at this time. The air-fuel ratio control apparatus in the third embodiment is intended to prevent the deterioration of the exhaust emission described above, by supplying intake air to the intake passage by means of the ISCV 50, the amount of the intake air supplied needed to cancel the excessive amount of the purge fuel.

Figure 15:
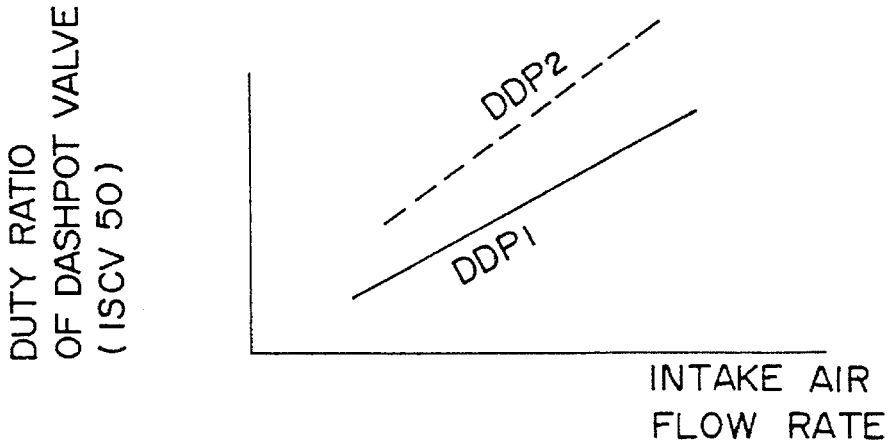
FIG. 15 is a chart showing maps used in a dash pot control routine in the third embodiment.
Figure 16:
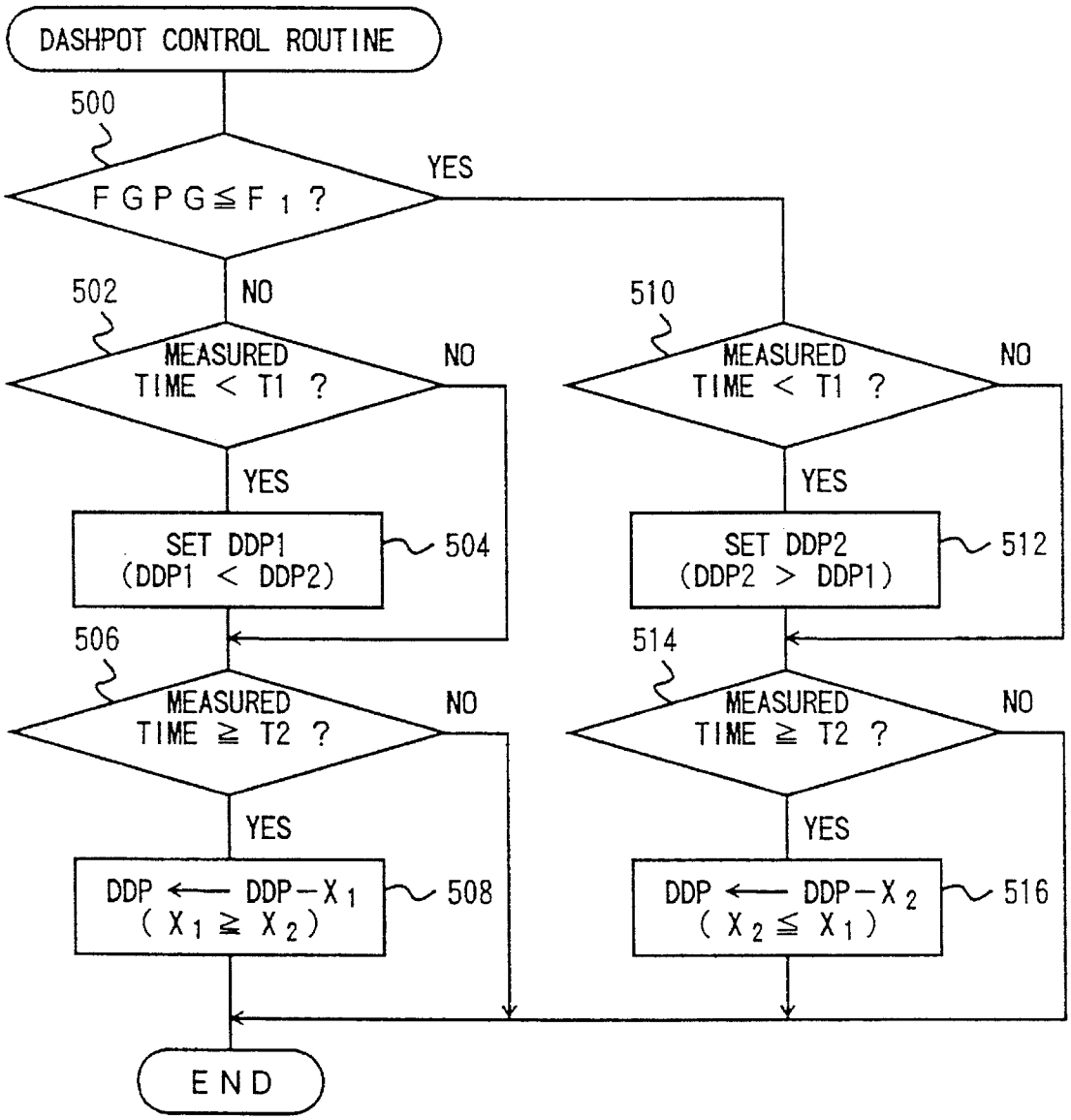
FIG. 16 is a flow chart for explaining the dash pot control routine executed by the electronic control unit in the third embodiment.

In the air-fuel ratio control apparatus in the third embodiment, a first map indicating the relationship between the ISCV drive signal duty ratio and the intake air flow rate for relatively small purge ratios, and a second map indicating the relationship between the ISCV drive signal duty ratio and the intake air flow rate for relatively great purge ratios are stored as shown in FIG. 15. A dashpot control routine in FIG. 16 is executed by the ECU 30 in the third embodiment. The dashpot control routine is executed as interrupts are periodically issued to the ECU 30. A duty ratio of the drive signal used to actuate the ISCV 50 is determined based on the duty ratio (DDP1 or DDP2) read from either the first map or the second map.

At the start of the dashpot control routine in FIG. 16, step 500 detects whether or not the purge fuel concentration factor FGPG, calculated at step 204 in FIG. 3, is equal to or smaller than the reference value F1.

When the result at step 500 is affirmative (FGPG≦F1), it can be determined that the air-fuel mixture to the engine is considerably affected by the purge fuel flow. In that case, steps 510 through 516 are performed. On the other hand, when the result at step 500 is negative (FGPG>F1), it can be determined that the air-fuel mixture to the engine is not considerably affected by the purge fuel flow. In that case, steps 502 through 508 are performed.

Step 502 (or step 510) detects whether or not a time measured from the sensing of the idle signal from the throttle switch 38 is smaller than a given time period T1. In the third embodiment mentioned above, a duty ratio of the ISCV drive signal is determined within the time period T1 after the closed condition of the throttle valve 19 is sensed.

Only when the result at step 502 (or step 510) is affirmative, step 504 (or step 512) is performed. Step 504 reads out a duty ratio value DDP1 from the first map based on the intake air flow rate, and sets a drive signal having the read duty ratio value DDP1 for the condition of FGPG>F1. Step 512 reads out a duty ratio value DDP2 from the second map based on the intake air flow rate, and sets a drive signal having the read duty ratio value DDP2 for the condition of FGPG≦F1. Generally, the duty ratio value DDP1 is smaller than the duty ratio value DDP2.

Step 506 (or step 514) detects whether or not the time measured from the sensing of the idle signal is equal to or greater than a given time period T2. If the result at step 506 (or step 514) is negative, the routine in FIG. 16 ends, and this step is repeated until the measured time exceeds the time period T2. The duty ratio of the drive signal supplied to the ISCV 50 at the start time is set to the duty ratio value DDP1 (or DDP2), and it is kept for the time period T2, as shown in FIG. 14A.

If the result at step 506 (or step 514) is affirmative, step 508 (or step 516) decrements the duty ratio of the drive signal, supplied to the ISCV 50, by a given first value X1 (or a given second value X2). That is, DDP←DDP−X1 or DDP←DDP−X2. The duty ratio of the drive signal supplied to the ISCV 50 is decreased at a given decreasing rate.

In the third embodiment described above, the first value X1 is equal to or smaller than the second value X2. When the air-fuel mixture to the engine is not considerably affected by the purge fuel flow, the duty ratio of the drive signal to the ISCV 50 is decreased at a relatively high decreasing rate. On the other hand, when the air-fuel mixture is considerably affected by the purge fuel flow, the duty ratio of the drive signal to the ISCV 50 is decreased at a relatively low decreasing rate.

In the third embodiment described above, an excessive amount of purge fuel, supplied from the purge control valve 27 to the intake passage during the fuel cut mode due to the control delay of the valve can be canceled by the amount of the intake air, supplied to the intake passage from the ISCV 50. Consequently, it is possible to maintain the exhaust emission at appropriate values even when the throttle valve is abruptly closed at a high intake air flow rate.

Figure 18:
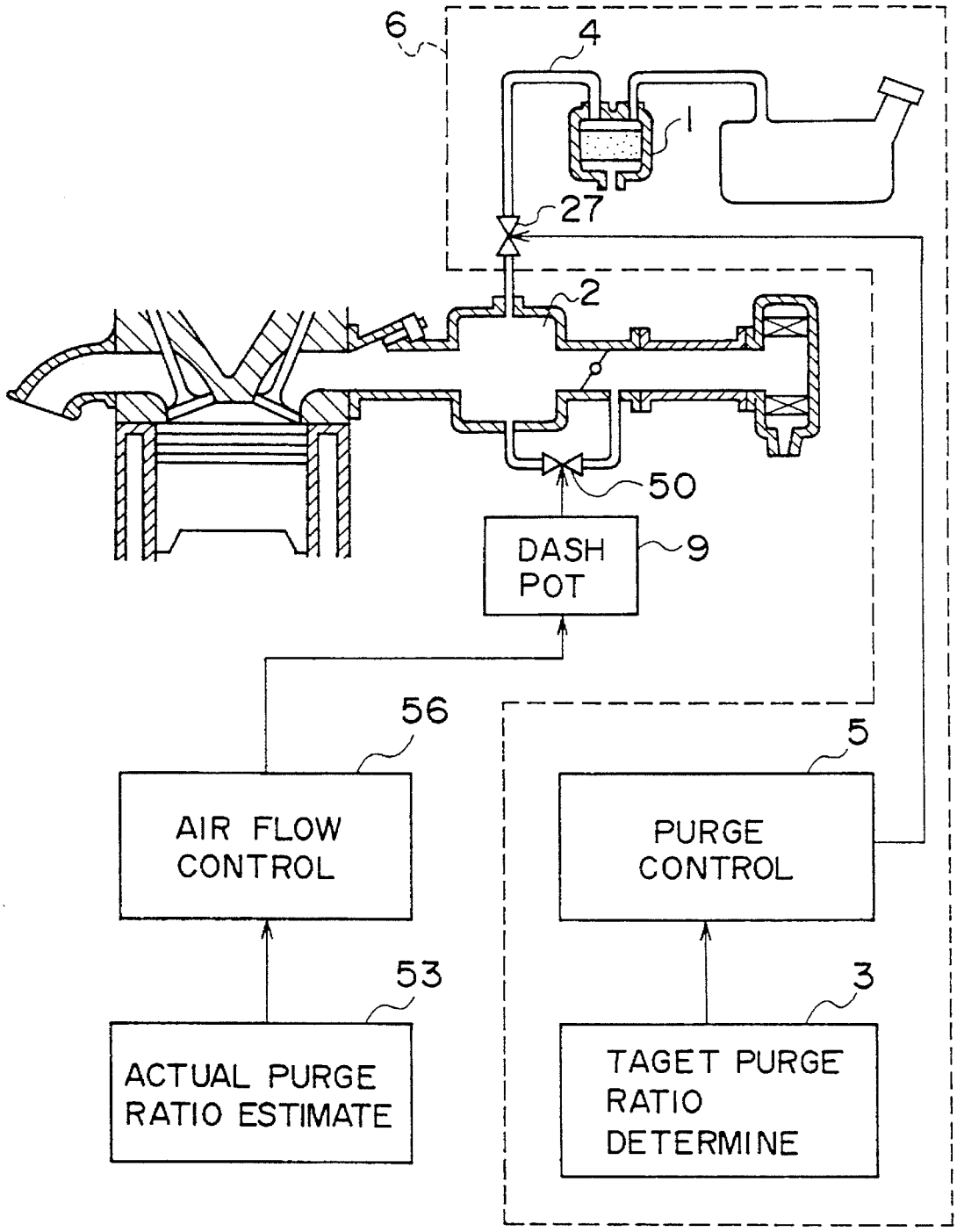
FIG. 18 is a diagram showing an air-fuel ratio control apparatus in the third embodiment.

FIG. 18 shows an air-fuel ratio control apparatus in the third embodiment of the present invention. The air-fuel ratio control apparatus in FIG. 18 comprises the target purge ratio determining part 3, the purge control part 5, the purge ratio estimating part 53, an air flow control part 56, and a dashpot valve part 9.

In FIG. 18, the target purge ratio determining part 3, the purge control part 5, and the purge ratio estimating part 53 are essentially the same as those corresponding parts shown in FIG. 10. The target purge ratio determining part 3 determines a target purge ratio in accordance with operating conditions of an internal combustion engine. The purge control part 5 controls a flow rate of evaporated fuel, supplied from an evaporated fuel purge system 6 into an intake passage 2 of the engine, by actuating a purge control valve 27 based on the target purge ratio, and for storing an evaporated fuel flow rate of the purge control valve 27.

The dashpot valve part 9 keeps a flow of intake air into the intake passage at a given flow rate when a throttle valve is closed, so as to prevent the flow of the intake air from abruptly decreasing.

The purge ratio estimating part 53 estimates a purge ratio, indicating the ratio of an evaporated fuel flow rate to an intake air flow rate, based on sensed operating conditions of the engine and on the stored evaporated fuel flow rate of the purge control part 5.

The air flow control part 56 sets the flow rate of the dashpot valve part 9 to a first air flow rate when an estimated purge ratio (FGPG) of the purge ratio estimating part 53 is greater than a given reference value (F1), and sets the flow rate of the dashpot valve part 9 to a second air flow rate when the estimated purge ratio (FGPG) of the purge ratio estimating part 53 is equal to or smaller than the given reference value (F1). The first air flow rate, produced by the dashpot valve part 9 by actuating a dashpot valve 50 with a drive signal having a relatively great duty ratio DDP1, is greater than the second air flow rate, produced by the dashpot valve part 9 by actuating the dashpot valve 50 with a drive signal having a relatively small duty ratio DDP2.

Figure 17:
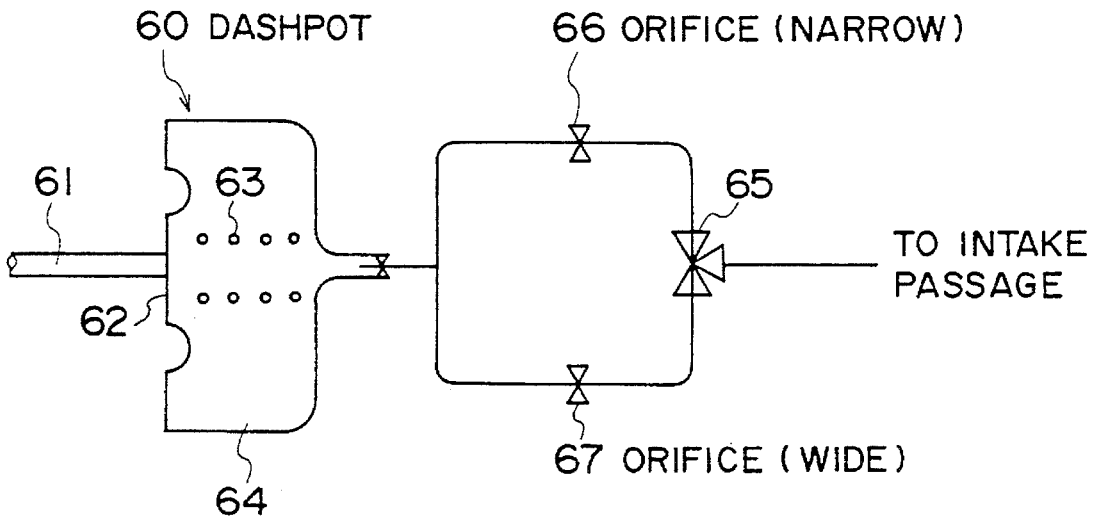
FIG. 17 is a diagram showing a dash pot which realizes the function of the air-fuel ratio control apparatus in the third embodiment.

FIG. 17 shows a dashpot valve which realizes the above described function of the air-fuel ratio control apparatus in the third embodiment. In FIG. 17, a dashpot 60 comprises a rod 61, a diaphragm 62, a spring 63, a vacuum chamber 64. The rod 61 presses a valve member of the throttle valve 19 in a valve opening direction. The spring 63 is included in the vacuum chamber 64 and biases the rod 61 in the valve opening direction through the diaphragm 62.

The vacuum chamber 64 is connected to the intake passage 16 at a portion downstream of the throttle valve 19. As the negative pressure in the intake passage becomes lower at a narrower opening of the throttle valve 19, the force of the rod 61, acting to press the valve member of the throttle valve 19 in the valve opening direction, is changed to a smaller force. Thus, the valve member of the throttle valve 19 can be gradually moved to make the opening of the throttle valve 19 smaller.

In the dashpot valve in FIG. 17, a switching valve 65 is connected to the intake passage 16, and a first orifice 66 and a second orifice 67 are arranged in two branch lines between the vacuum chamber 64 and the intake passage 16. The first orifice 66 has a relatively narrow opening, and the second orifice 67 has a relatively wide opening.

When the air-fuel mixture to the engine is detected to be considerably affected by the purge fuel flow, the switching valve 65 is set to connect the intake passage 16 and the vacuum chamber 64 through the first orifice 66. The flow rate of intake air to the intake passage can be made relatively high after the throttle valve is closed. On the other hand, when the air-fuel mixture to the engine is detected not to be considerably affected by the purge fuel flow, the switching valve 65 is set to connect the intake passage 16 and the vacuum chamber 64 through the second orifice 67. The flow rate of intake air to the intake passage can be made relatively low after the throttle valve is closed.

Therefore, the air-fuel ratio control apparatus provided with the dashpot valve, shown in FIG. 17, can realize the function of the air-fuel ratio control apparatus in FIG. 18.

Next, a description will be given of an air-fuel ratio control apparatus in the fourth embodiment of the present invention. The air-fuel ratio control apparatus in the fourth embodiment is applied to the internal combustion engine shown in FIG. 1.

Figure 19:
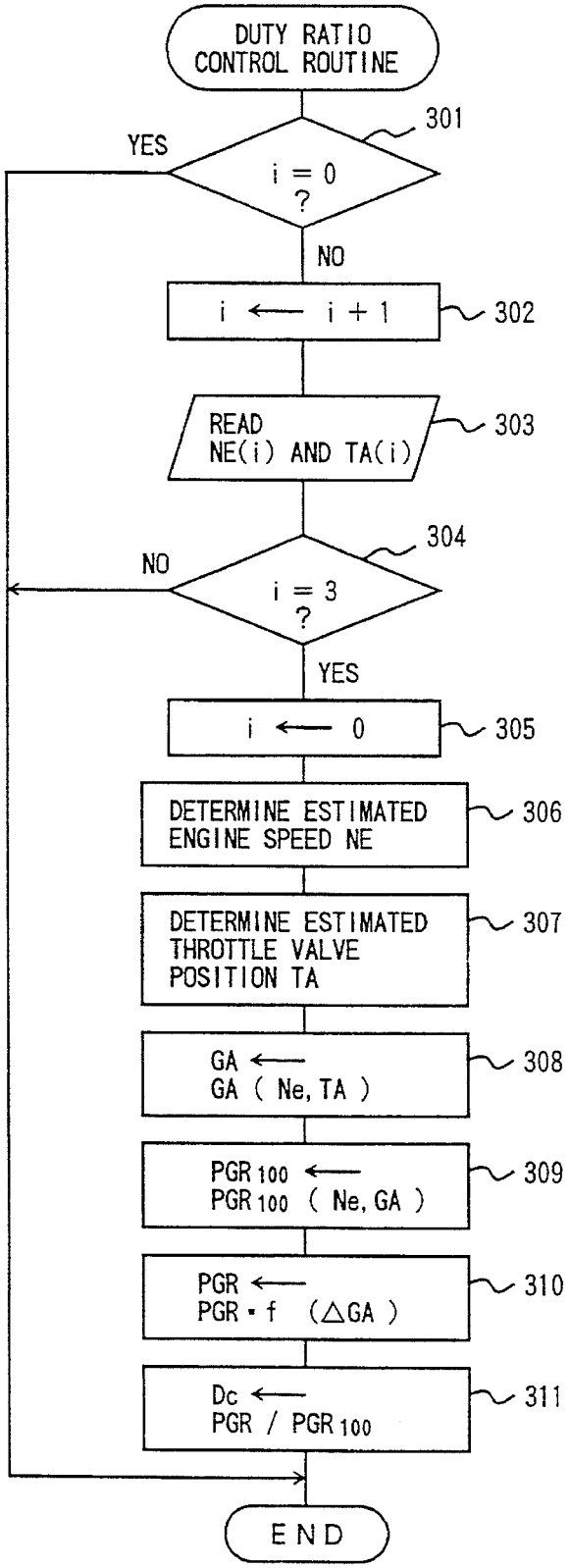
FIG. 19 is a flow chart for explaining a duty ratio control routine executed by the electronic control unit in the fourth embodiment.

FIG. 19 shows a duty ratio control routine executed by the ECU 30 in the fourth embodiment. This duty ratio control routine is executed as interrupts are issued to the ECU 30 at a sampling period Ts.

As described above, the purge control valve 27 is a vacuum switching valve (VSV) which is actuated in accordance with a drive signal having a duty ratio Dc. The purge control valve 27 has a control delay in response to the drive signal, and it is actually actuated to open or close the purge line 26 after the control delay has elapsed since the issue of the drive signal. The control delay of the purge control valve 27 is approximately 100 ms. The duty ratio Dc is determined by executing the duty ratio control routine in FIG. 19 at the sampling period Ts.

A drive signal having the duty ratio Dc, obtained by the duty ratio control routine, is output from the ECU 30 to the purge control valve 27 at a valve drive period Tc. It is necessary that the valve drive period Tc is greater than a minimum response period Tmin of the purge control valve 27, and that the sampling period Ts is smaller than the valve drive period Tc.

It is desirable to set the sampling period Ts to a divisor of the valve drive period Tc divided by an integer (Ts=1/m.Tc where m: an integer). For example, in the duty ratio control routine in FIG. 19, the sampling period Ts is set to one fourth of the valve drive period Tc, and the valve drive period Tc is set to 100 ms. Thus, the sampling period Ts is equal to 25 ms (=¼.100 ms). In this example, the duty ratio control routine is repeatedly executed at least three times within one valve drive period Tc.

At the start of the duty ratio control routine in FIG. 19, step 301 detects whether or not the index "i" is equal to zero. If the result at step 301 is affirmative, the start of the current sampling period Ts accords with the start of the valve drive period Tc. At this time, the duty ratio control routine in FIG. 19 ends. That is, when the drive signal is output to the purge control valve 27, the duty ratio Dc is not acquired by the duty ratio control routine at that sampling period.

If the result at step 301 is negative, step 302 increments the index "i" (i←i+1). After step 302 is performed, step 303 reads out the current engine speed NE(i) sensed from the engine, and reads out the current throttle valve position TA(i) sensed from the engine.

Step 304 detects whether or not the index "i" is equal to 3. If the result at step 304 is negative, the duty ratio control routine in FIG. 19 ends.

If the result at step 304 is affirmative, step 305 resets the index "i" to zero.

Step 306 determines an estimated engine speed NE for the next valve drive period Tc, based on the engine speeds NE(1), NE(2) and NE(3) previously read at step 303. To determine the estimated engine speed NE for the next valve drive period Tc, a derivative function dN/dt of engine speed at the sampling time when the index "i" is equal to 3, is determined based on the previously read engine speeds NE (1) through NE(3).

$$dN/dt=f\{NE(1), NE(2), NE(3)\}$$

To determine the derivative function dN/dt, a regression curve (a quadratic curve) passing through points of the read engine speeds in an engine speed time chart, is found by using the least squares method. The derivative function dN/dt of engine speed can be found by calculating a derivative coefficient of the regression curve at the sampling time when the index "i" is equal to 3. Therefore, the estimated engine speed NE for the next valve drive period Tc can be determined as follows.

$$NE=\alpha(dN/dt).Ts+NE(3)$$

where $\alpha$ is a constant factor and Ts is the sampling period.

Step 307 determines an estimated throttle valve position TA for the next valve drive period Tc, based on the throttle valve positions TA(1), TA(2) and TA(3) previously read at step 303. The estimated throttle valve position TA for the next valve drive period Tc can be determined in the same manner as that of the estimated engine speed NE at step 306.

$$dT/dt=g\{TA(1), TA(2), TA(3)\}$$

$$TA=\beta.(dT/dt).Ts+TA(3)$$

where $\beta$ is a constant factor and Ts is the sampling period.

Step 308 determines an estimated intake air flow rate GA in accordance with a map, indicating the relationship between the engine speed and the throttle valve position, based on the estimated engine speed NE and the estimated throttle position TA.

Figure 20:
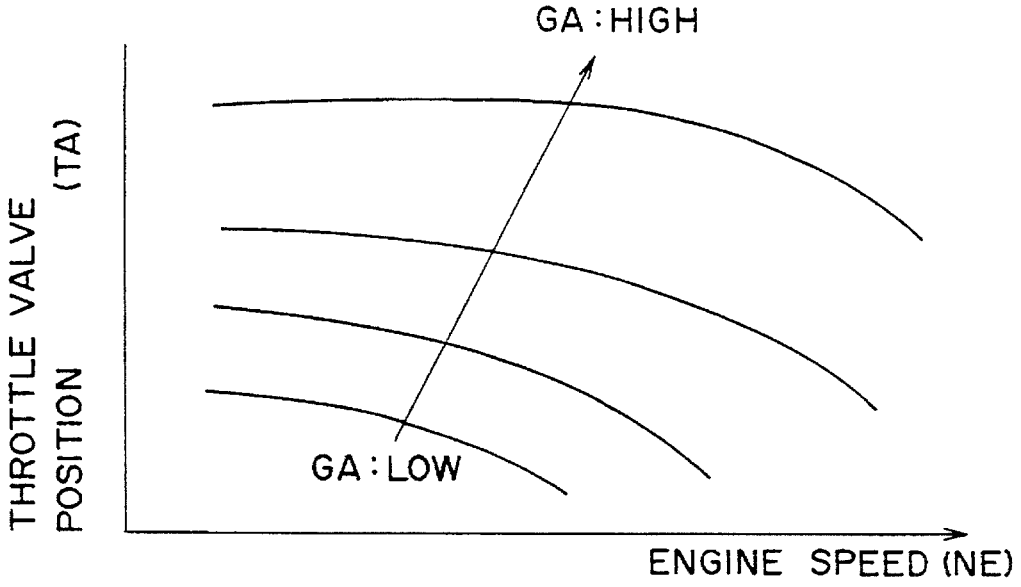
FIG. 20 is a diagram showing a map used in the duty ratio control routine in FIG. 19.

FIG. 20 shows a map used in the duty ratio control routine in FIG. 19 to determine an estimated intake air flow rate from the relationship between the engine speed and the throttle valve position.

Step 309 determines a maximum purge ratio PRG100 based on the estimated engine speed NE and the estimated intake air flow rate GA. The maximum purge ratio PRG100 is a function of the engine speed and the throttle valve position, and it indicates the maximum flow rate of evaporated fuel supplied from the evaporated fuel purge system to the intake passage when the purge control valve 27 is fully opened.

$$PRG100=PRG100\ (NE, GA).$$

Figure 23:
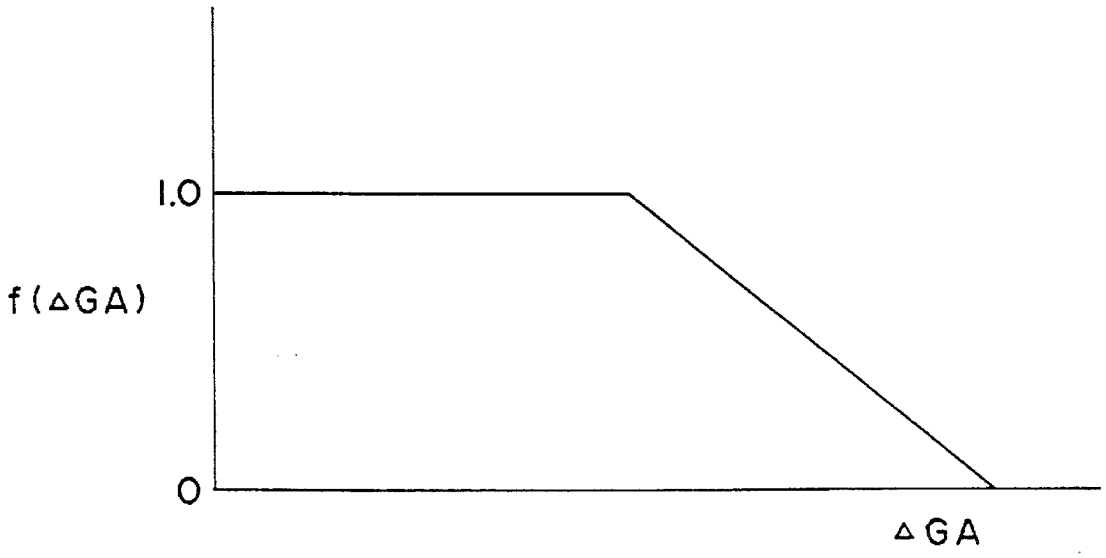
FIG. 23 is a chart showing the relationship between the estimated intake air flow rate change and the correction coefficient.

Step 310 determines a corrected purge ratio PRG based on the estimated intake air flow rate GA and a measured intake air flow rate GAA. The current corrected purge ratio PRG is calculated by multiplying the previous corrected purge ratio PRG by a correction coefficient. The correction coefficient is a function of the change of the estimated intake air flow rate GA to the measured intake air flow rate GAA.

$$\delta GA=|GA-GAA|$$

$$\delta PRG=PRG.f(\delta GA)$$

where $\delta$GA is the change of the estimated intake air flow rate to the measured intake air flow rate and GAA is the measured intake air flow rate sensed by the air flow meter of the engine. FIG. 23 shows the relationship between the estimated intake air flow rate change $\delta$GA and the correction coefficient f($\delta$GA).

Step 311 determines a value of the duty ratio Dc of the drive signal based on the corrected purge ratio PRG and the maximum purge ratio PRG100. The duty ratio Dc indicates the ratio of the corrected purge ratio to the maximum purge ratio.

$$Dc=PRG/PRG100$$

After step 311 is performed, the duty ratio control routine in FIG. 19 is completed.

Figure 21A:
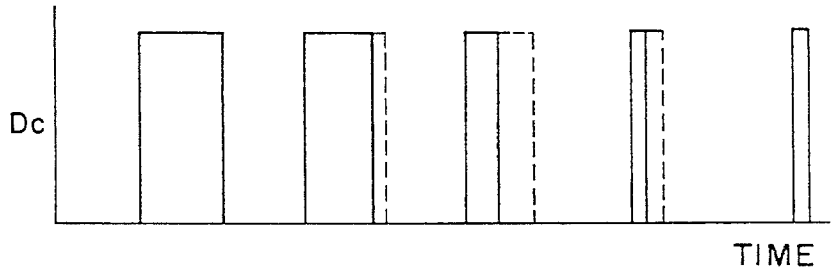
FIGS. 21A through 21D are time charts for explaining operations of the engine when the duty ratio control routine is performed.
Figure 21B:
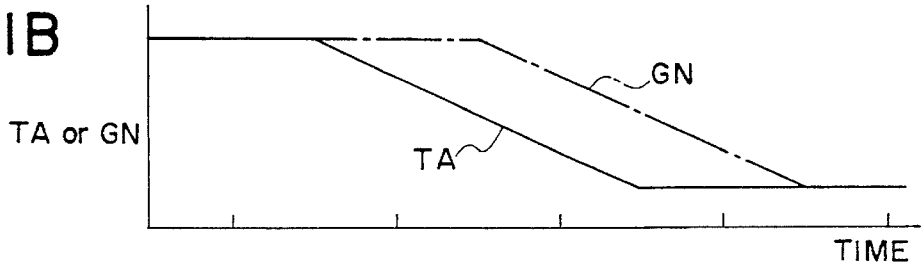
Figure 21C:
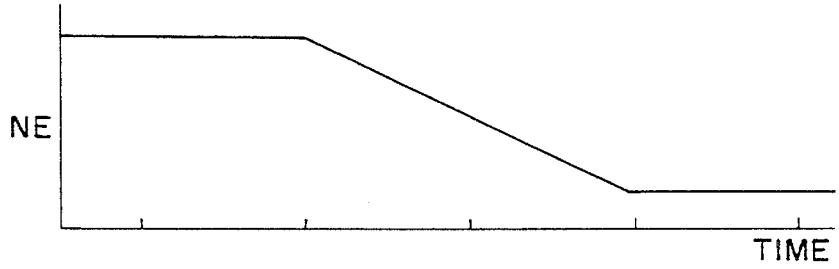
Figure 21D:
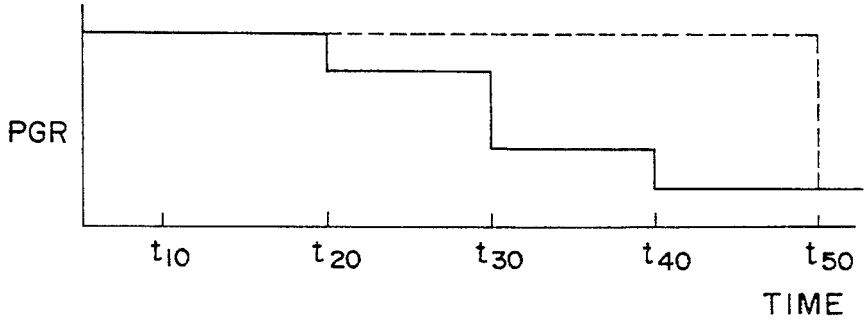
Figure 22A:
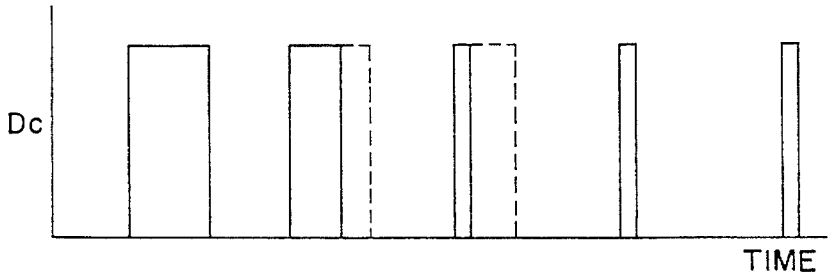
FIGS. 22A through 22D are time charts for explaining operations of the engine when the duty ratio control routine is performed.
Figure 22B:
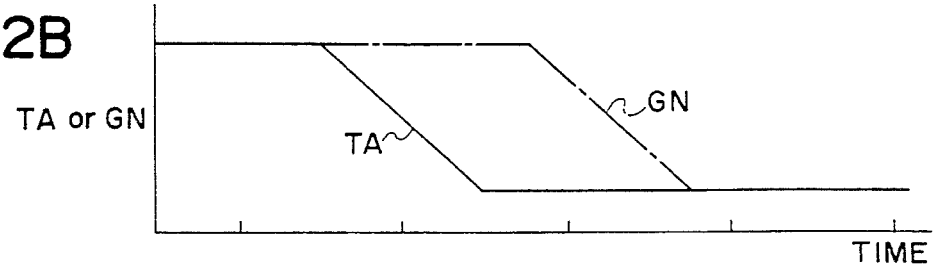
Figure 22C:
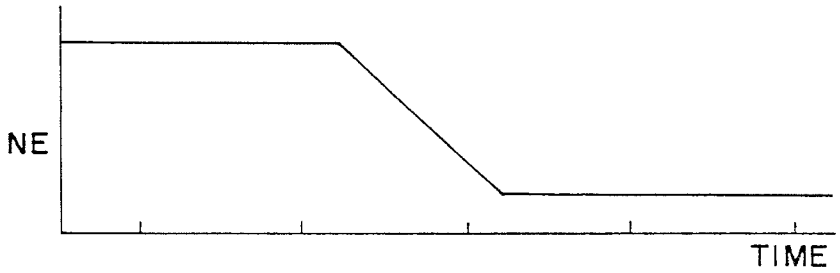
Figure 22D:
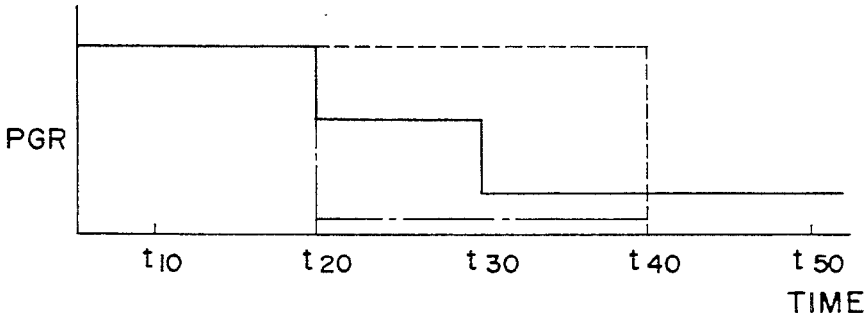

FIGS. 21A through 21D show operations of the engine when the purge control valve is actuated in accordance with the drive signal obtained by the duty ratio control routine. FIG. 21A shows the change of the duty ratio Dc obtained from the duty ratio control routine in FIG. 19. FIG. 21B shows the changes of the throttle valve position TA and the intake air flow rate GN. FIG. 21C shows the change of the engine speed NE. FIG. 21D shows the change of the purge ratio PRG.

In FIGS. 21A and 21D, the change of the duty ratio Dc and the change of the purge ratio PRG according to the present invention are indicated by solid lines, and the change of the duty ratio Dc and the change of the purge ratio PRG according to the conventional apparatus are indicated by dotted lines.

As is apparent from FIGS. 21A through 21D, the purge fuel flow rate can be controlled at an appropriate value when the intake air flow rate abruptly changes, and the air-fuel ratio control apparatus in the fourth embodiment makes possible that the air-fuel mixture supplied to the intake passage is not considerably affected by the purge fuel flow.

In the case shown in FIGS. 21A through 21D, both the factors $\alpha$ and $\beta$ are set to 1.0. When the absolute value of the derivative function dN/dt of the engine speed (or the absolute value of the derivative function dT/dt of the throttle valve position) is greater than or equal to a given threshold value, the factors $\alpha$ and $\beta$ may be set to values that are greater than 1.0.

FIGS. 22A through 22D shows operations of the engine when the factors $\alpha$ and $\beta$ are set to values greater than 1.0 and the purge control valve is controlled in the same manner as shown in FIGS. 21A through 21D. As is apparent from FIGS. 22A through 22D, even if the throttle valve is set to the closed condition very quickly, the purge control valve can be quickly set to the minimum opening condition in response to the change of the throttle valve position.

Further, the present invention is not limited to the above described embodiments, and variations and modifications may be made without departing from the scope of the present invention.

What is claimed is:

1. An apparatus for controlling an air-fuel ratio of an air-fuel mixture supplied to an internal combustion engine having an evaporated fuel purge system, said apparatus comprising:

target purge ratio determining means for determining a target purge ratio in accordance with operating conditions of an internal combustion engine;

purge control means for controlling a flow rate of evaporated fuel, supplied from an evaporated fuel purge system into an intake passage of the engine, by actuating a purge control valve based on said target purge ratio, and for storing an evaporated fuel flow rate of the purge control valve;

fuel injection control means for generating a drive signal in accordance with a fuel injection time, and for controlling an air-fuel ratio of an air-fuel mixture supplied to the engine by actuating a fuel injection valve in accordance with said drive signal;

estimating means for estimating the ratio of an evaporated fuel flow rate to an intake air flow rate based on sensed operating conditions of the engine and on the stored evaporated fuel flow rate of the purge control means; and fuel injection time determining means for determining a fuel injection time based on the estimated ratio from said estimating means, and for supplying said fuel injection time to said fuel injection control means.

2. An apparatus according to claim 1, wherein said evaporated fuel purge system comprises a canister for absorbing evaporated fuel from a fuel tank, and the purge control valve for supplying the evaporated fuel of said canister to the intake passage of the engine, the purge control valve being arranged at an intermediate portion in a purge line between the canister and the intake passage.

3. An apparatus according to claim 1, wherein said estimating means reads out a value of the stored evaporated fuel flow rate from a memory in accordance with an engine speed sensed from the engine.

4. An apparatus according to claim 1, wherein said estimating means reads out a value of the delay of the purge control valve from a memory in accordance with an engine speed sensed from the engine.

5. An apparatus for controlling an air-fuel ratio of an air-fuel mixture supplied to an internal combustion engine in response to an amount of intake air supplied to said engine by actuating a fuel injection valve, said engine having an evaporated fuel purge system, wherein said evaporated fuel purge system includes:

intake air detecting means for detecting an amount of intake air supplied to the engine;

a canister which temporarily absorbs evaporated fuel;

a purge control valve arranged in a purge line between said canister and an intake line of said engine;

a target purge ratio determining unit which determines a target purge ratio in accordance with operating conditions of said engine; and a purge control unit which controls an amount of evaporated fuel supplied from said canister into said intake line through the purge passage by actuating said purge control valve in accordance with said target purge ratio, wherein the purge control unit stores a control factor related to an amount of evaporated fuel purged during a current period;

said apparatus for controlling an air-fuel ratio comprising:

estimating means for determining a corrected control factor related to an amount of evaporated fuel to be purged during a subsequent period in accordance with the operating conditions of said engine, wherein the subsequent period begins a predetermined time period after the current period; and air-fuel ratio control means for determining an air-fuel ratio of the air-fuel mixture for the subsequent period based on said corrected control factor from said estimating means, and for actuating the fuel injection valve in accordance with said air-fuel ratio.

6. The apparatus according to claim 5, wherein said estimating means includes:

means for determining the corrected control factor based on the control factor stored in said purge control unit for the current period and the length of the predetermined time period.

7. The apparatus according to claim 5, wherein said air-fuel ratio control means includes:

means for determining a corrected fuel injection time for the subsequent period based on the corrected control factor determined by said estimating means and based on the amount of intake air detected by the intake air detecting means.

8. The apparatus according to claim 5, further comprising detecting means for reading engine speeds from said engine at sampling periods, and for reading positions of a throttle valve of said engine at the sampling periods, wherein said estimating means includes:

means for determining a corrected amount of the intake air for the subsequent period based on the engine speeds and the throttle valve positions from said detecting means, and for determining said corrected control factor based on the corrected amount of the intake air and the amount of the intake air detected by the intake air detecting means.

9. The apparatus according to claim 8, wherein said air-fuel ratio control means includes:

means for determining a corrected fuel injection time for the subsequent period based on the corrected control factor from said estimating means and based on the amount of the intake air detected by the intake air detecting means.

* * * * *

UNITED STATES PATENT AND TRADEMARK OFFICE

CERTIFICATE OF CORRECTION

PATENT NO. : 5,476,081

DATED : 19 December 1995

INVENTOR(S) : Koji OKAWA et al.

It is certified that error appears in the above-identified patent and that said Letters Patent is hereby corrected as shown below:

| Column | Line | |
|---|---|---|
| 1 | 29 | Change "engines" to --engine--. |
| 10 | 39 | Change "reaches" to --reached--. |
| 12 | 21 | Change "has" to --is--. |
| 14 | 34 | After "second" insert --minimum--. |
| 14 | 35 | Change "TAUMin2," to --TAUmin2,--. |
| 18 | 49 | Change "(Ts=1/m.Tc" to --(Ts=1/m·Tc--. |
| 18 | 54 | Change "(=1/4.100 ms)" to --(=1/4 · 100 ms)--. |
| 19 | 27 | Change "*NE=α (dN/dt).Ts+NE(3)*" to --*NE=α (dN/dt)· Ts+NE(3)*--. |

UNITED STATES PATENT AND TRADEMARK OFFICE

CERTIFICATE OF CORRECTION

PATENT NO. : 5,476,081

DATED : 19 December 1995

INVENTOR(S) : Koji OKAWA et al.

It is certified that error appears in the above-identified patent and that said Letters Patent is hereby corrected as shown below:

| Column | Line | |
|---|---|---|
| 19 | 39 | Change "$TA=\beta.(dT/dt).Ts+TA(3)$" to --$TA=\beta\cdot(dT/dt)\cdot Ts+TA(3)$--. |
| 20 | 3 | Change "$\delta PRG=PRG.f(\delta GA)$" to --$\delta PRG=PRG\cdot f(\delta GA)$--. |

Signed and Sealed this

Twenty-eighth Day of March, 2000

*Attest:*

*Attesting Officer*

Q. TODD DICKINSON

*Commissioner of Patents and Trademarks*